US005425297A

United States Patent [19]

Young, Jr.

[11] Patent Number: 5,425,297

[45] Date of Patent: Jun. 20, 1995

[54] ELECTRONIC MUSICAL INSTRUMENT WITH DIRECT TRANSLATION BETWEEN SYMBOLS, FINGERS AND SENSOR AREAS

[75] Inventor: Leroy D. Young, Jr., Davie, Fla.

[73] Assignee: Conchord Expert Technologies, Inc., Miami, Fla.

[21] Appl. No.: 21,524

[22] Filed: Feb. 19, 1993

Related U.S. Application Data

[63] Continuation-in-part of Ser. No. 898,206, Jun. 10, 1992, abandoned.

[51] Int. Cl.[6] ..... G10H 7/00; G10H 1/38

[52] U.S. Cl. ..... 84/483.2; 84/479 A; 84/613; 84/615; 84/744

[58] Field of Search ..... 84/615, 617, 723, 737, 84/745, 746, 600, 613, 470 R, 477 R, 478, 479 R, 479 A, 483.2, 485 R, 743, 744

[56] References Cited

U.S. PATENT DOCUMENTS

| | | | |
|---|---|---|---|
| Re. 33,607 | 6/1991 | Yuzawa et al. | 84/609 |
| 3,439,568 | 4/1969 | Griffith . | |
| 3,555,166 | 1/1971 | Gasser | 84/600 |
| 3,700,785 | 10/1972 | Leonard | 84/470 R |
| 3,888,155 | 6/1975 | Leonard | 84/471 |
| 3,890,875 | 6/1975 | Leonard | 84/471 |
| 3,916,754 | 11/1975 | Thiel | 84/402 |
| 4,009,633 | 3/1977 | Coles | 84/1.01 |
| 4,048,893 | 9/1977 | Coles | 84/1.01 |
| 4,054,079 | 10/1977 | Sohler | 84/423 |
| 4,056,032 | 11/1977 | Coles | 84/1.01 |
| 4,140,039 | 2/1979 | Faulkner . | |
| 4,198,890 | 4/1980 | Massey et al. | 84/1.01 |
| 4,203,345 | 5/1980 | Collin et al. | 84/478 |
| 4,206,676 | 6/1980 | Adachi et al. | 84/1.03 |
| 4,304,161 | 12/1981 | Franzmann . | |
| 4,491,050 | 1/1985 | Franzmann . | |
| 4,655,117 | 4/1987 | Roose | 84/423 |
| 4,794,838 | 1/1989 | Corrigan, III . | |
| 4,852,443 | 8/1989 | Duncan et al. . | |
| 4,885,969 | 12/1989 | Chesters . | |
| 4,926,734 | 5/1990 | Rickey | 84/423 |
| 4,932,304 | 6/1990 | Franzmann | 84/671 |
| 4,961,363 | 10/1990 | Mizuro et al. . | |
| 5,099,738 | 3/1992 | Hotz . | |
| 5,105,708 | 4/1992 | Suzuki et al. . | |
| 5,117,730 | 6/1992 | Yamauchi . | |
| 5,147,969 | 9/1992 | Hiyoshi et al. . | |
| 5,192,826 | 3/1993 | Aoki | 84/737 |
| 5,223,658 | 6/1993 | Suzuki | 84/663 |

OTHER PUBLICATIONS

"Trumpet Fingering Chart" Feldstein et al., p. 2, 1988, Alfred Pub. Co.

"Logitech Mouse Users Manual—1.10.1 Scroll With the Mouse" p. D-25, Logitech, Inc., 1988.

*Primary Examiner*—William M. Shoop, Jr.
*Assistant Examiner*—Jeffrey W. Donels
*Attorney, Agent, or Firm*—Price, Gess & Ubell

[57] ABSTRACT

A new electronic musical instrument and an associated notational method are disclosed. The new musical instrument is played using the right hand for depression of keys, as in conventional instruments, and also by applying finger pressure onto special sensing areas using the left hand. The left hand sensing areas or keys are located so as to be accessed without any significant lateral movement of the left hand. "Instructions" for playing the new instrument are conveyed to the user via directly translatable notational symbols printed on an associated surface. This cooperating system removes the mental translational and physical movement problems of conventional notation and conventional instruments by having the notational method directly convey the physical actions that are required and by simplifying the physical actions themselves. Such a cooperative system allows users to quickly play this instrument at advanced levels.

33 Claims, 18 Drawing Sheets

FIG. 2
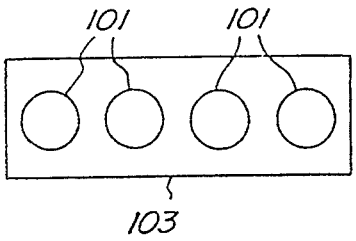
FIG. 3
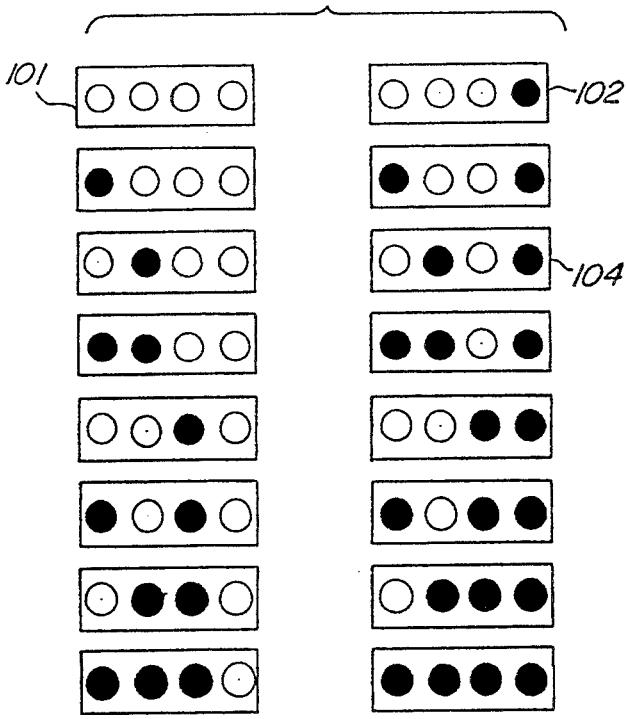
FIG. 4
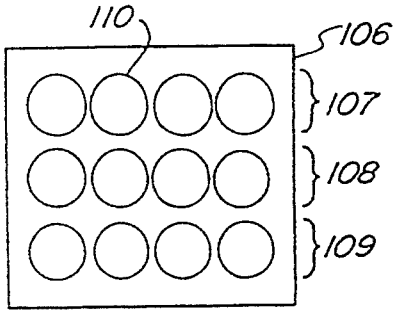
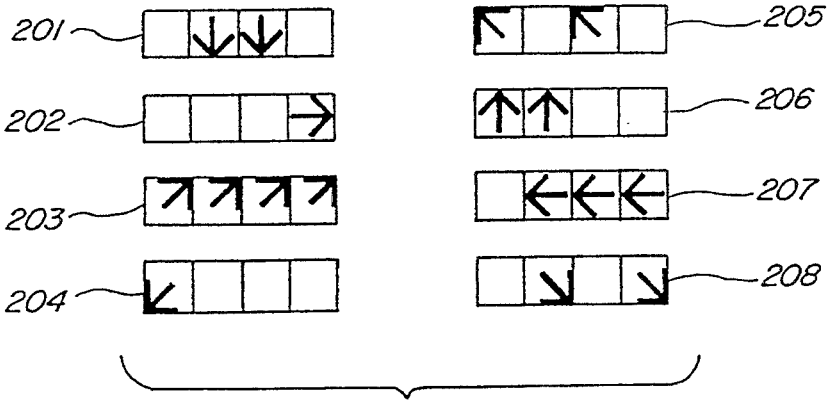
FIG. 5

15
12
19
TABLE
16
SOUND GEN. MEANS
75
COMP. MEANS
57
INPUT MODE CONTROL (14)
18
M U X
1
2
12
74
76
SCAN CONTROL
53
A/D CONVERTER
SCAN CONTROL (ANALOG)
51
MUX
56
R1
R2
R3
R4
+V
41
50
FSR1
SENSOR 1
FSR2
SENSOR 2
FSR3
SENSOR 3
FSR4
SENSOR 4
= FORCE SENSITIVE RESISTOR
47
21
23
25
27

332

331

| | | CHORD | | | | BASS NOTES | | | | | | | | | | |
|---|---|---|---|---|---|---|---|---|---|---|---|---|---|---|---|---|
| ○○○● | = G7 | G | B | D | F | G | B | D | E | F | | | | | | |
| ○○●○ | = C MAJ | $C_2$ | E | G | $C_3$ | $C_1$ | E | G | A | $C_2$ | | | | | | |
| ○○●● | = C MAJ7 | $C_2$ | E | G | B | $C_1$ | E | G | A | B | | | | | | |
| ○●○○ | = C7 | $C_2$ | E | $B^b$ | $C_3$ | $C_1$ | E | G | A | $B^b$ | | | | | | |
| ○●○● | = DMIN7 | $D_2$ | A | C | F | D | F | G | A | C | | | | | | |
| ○●●○ | = A7 | A | $C^\#$ | E | G | A | $C^\#$ | E | $F^\#$ | G | | | | | | |
| ○●●● | = A MIN | A | E | A | C | $A_1$ | C | D | E | $A_2$ | | | | | | |
| ●○○○ | = F MAJ | $F_2$ | C | $F_3$ | A | $F_1$ | A | C | D | $F_2$ | | | | | | |
| ●○○● | = FMIN | $F_2$ | C | $F_3$ | $A^b$ | $F_1$ | $A^b$ | $B^b$ | C | $F_2$ | | | | | | |
| ●○●○ | = D7 | $D_2$ | $F^\#$ | C | $D_3$ | $D_1$ | $F^\#$ | A | B | C | | | | | | |
| ●○●● | = EMIN | $E_2$ | B | $E_3$ | G | $E_1$ | A | A | B | $E_2$ | | | | | | |
| ●●○○ | = Bb maj | $B_2^b$ | F | $B_3^b$ | $D_2$ | $B_1^b$ | D | F | G | B | | | | | | |
| ●●○● | = GMIN7 | $G_2$ | D | $G_3$ | $B^b$ | $G_1$ | $B^b$ | C | D | $G_2$ | | | | | | |
| ●●●○ | = G+ | $G_2$ | B | $E^b$ | $G_3$ | $G_1$ | B | D | E | $G_2$ | | | | | | |
| ●●●● | = C# DIM | $E_2$ | B | $E_3$ | $A^b$ | $E_1$ | $A^b$ | B | C# | D | | | | | | |

$A^b$ = A FLAT $C^\#$ = C SHARP $C_1$ = C NOTE AT FREQUENCY 1

$C_2$ = C NOTE AT FREQUENCY 2

FIG. 9

| CHORD TYPE \ CHORD NAME | B | E | A | D | G | C | F | B♭ | E♭ | A♭ | C# | F# |
|---|---|---|---|---|---|---|---|---|---|---|---|---|
| MAJOR | | L | | | H | H | H | ML | L | | | |
| SEVENTH | | L | L | L | MH | MH | L | | | | | |
| MINOR | | ML | M | M | | | ML | | | | | |
| MINOR 7 | | L | L | M | | | L | | | | | |
| MAJOR 7 | | | | L | | ML | M | | | | | |
| NINTH | | | | L | L | L | | | | | | |
| SUS 4 | | | | | L | | | | | | | |
| SIXTH | | | | | | | | | L | | | |
| MINOR 6 | | | | | L | L | L | | | | | |

A SET OF 31 CHORDS BASED ON PROBABILITY OF OCCURANCE IN POPULAR MUSIC.

H = HIGH PROBABILITY OF OCCURING

MH = MEDIUM/HIGH PROBABILITY OF OCCURING

M = MEDIUM PROBABILITY OF OCCURING

ML = MEDIUM/LOW PROBABILITY OF OCCURING

L = LOW PROBABILITY OF OCCURING (BLANKS ARE ZERO PROBABILITY OF OCCURING)

FIG. 15

CONCHORD NOTATION

ON TOP OF OLD SMOKY

ELECTRONIC MUSICAL INSTRUMENT WITH DIRECT TRANSLATION BETWEEN SYMBOLS, FINGERS AND SENSOR AREAS

This application is a continuation-in-part of U.S. application Ser. No. 07/898,206 filed Jun. 10, 1992, abandoned.

BACKGROUND OF THE INVENTION

1. Field of the Invention

The subject invention relates generally to musical instruments and, more particularly, to an electronic instrument and integrally-related notational scheme which facilitate ease of play.

2. Description of Related Art

Music has historically been notated using the familiar five-line staff and notes. Single notes or chords (three or more notes) may be notated. Such notation is not instrument specific. That is, the same notation may be used to play a guitar, piano, or other similar instrument when used by appropriately trained musicians. This notation, however, has been a source of frustration for aspiring musicians independent of the instrument they are trying to learn to play. Literally hundreds of thousands of people have given up trying to "read music," due to the difficulties associated with such an effort. The inventor believes that the major problems with learning to read music are twofold: the mental translation aspect of conventional notation, and the physical movement requirements of the instrument itself.

The mental translation problem for conventional notation and instruments is as follows: a notational symbol (note) is presented to the would-be musician and he or she, by prior rote memorization, must determine the name of the note that is intended to be conveyed. Having determined the intended note name by this first translation, the user still does not necessarily know where to physically find that note on his or her instrument. He or she must then mentally translate the note name into the required physical location on his or her instrument—another translation.

The second difficulty is the actual physical movement that is required of the user, after the above two mental translations are complete, to properly locate and properly activate the appropriate key or string on his or her instrument. Needless to say, being able to accomplish the mental translations, and physically execute the "instructions" in the time allocated by the musical tempo, appears impossible to many would-be musicians.

Various techniques and devices, such as chord organs, two-finger chording schemes, color-coded keys and notes, special typewriter keyboards, and tablature notation, etc., have been presented as alternatives to strict conventional instruments and notation. None of these have eliminated both the mental translational and the physical movement problems just described.

Some of these devices have used combinations of fingerings of switches or keys to cause the activation of musical events. In this context, musical events can be thought of as chords, or notes, or other musical or percussive tones. In fact, "normal" chording on a keyboard uses such "combinations" of fingerings to generate chords. However, chord organs were probably the first products to use activations of "shorthand" combinations (selected from rows and columns of buttons) to cause the production of musical chords. This method required many buttons to do all 12 root names and a few chord types for each root. One implementation of this method required 12 rows of buttons and perhaps 7 buttons per row (84 buttons) where the rows represented root names such as A, Bb, C, C#, etc., and the buttons in the row allowed the user to then select one of 7 chords such as major, minor, etc. by depressing one of the associated buttons.

Later, organ manufacturers used a standard keyboard and another "shorthand" method to produce chords. These so-called "two-finger" chord systems required the user to press one key (the root note) to generate major chords, plus from one to three additional keys to generate the other chord variations such as minors and sevenths, etc.

A third shorthand method used by Suzuki in its Omnichord product uses 12 rows of 3 buttons. But instead of having individual buttons represent individual chords as in the chord organ, this product uses the binary combination of the three buttons to create seven chord possibilities. Although this is more efficient than having 7 separate chord buttons per row, it adds the complication and difficulty of having to memorize the 7 coding combinations and requires the user to search the 12 rows for the appropriate root position.

In all these cases, and in all cases of which the inventor is aware for one-hand chording techniques, the inventions have at least two things in common: all use a distinct row position or key position for each of the 12 root names and all are very difficult to use due to the resulting physical movement and mental translation required on the part of the user. Either a full row of buttons has been used for one root (chord organ, Omnichord, etc.), another row for the next root, etc. or, in the case of a keyboard, a root key was used for C, another key for C#, etc. This causes the user to have to "search" (visually and then physically) for the root position first, and then remember the fingering codes for the desired chord. This has made the musical success of such systems very limited, although the "two-finger" system is widespread in terms of being incorporated into products.

Although these techniques are touted as simpler than conventional keyboard chord fingerings (due to consistency of fingering over the 12 roots), the methods are still flawed by the most problematic barriers to playing music—physical movement and mental translation. The prior art approach of making all 12 distinct positions for root notes (and associated chords) available appears to be based on a very erroneous assumption; that is, that all chord types must be available in all key root positions at all times. In fact, this inventor has found that in popular and jazz music, the occurrence of chord types is very predictable, and that many chord types typically do not occur except in very specific situations.

There has been little or no effort in the prior art directed at simplifying the translation from notational symbology to finger movements on the instrument. Certain simple geometric figures have also been used in the past for instructional purposes. One is in training of beginning trumpet players. At least one instructional trumpet book shows three circles under notes of a regular staff with one or more of the circles darkened. The instructions convey to the student that the forefinger, middle finger, or ring finger should press on a valve of the trumpet if the circle corresponding to the finger over that valve is darkened. Once the player learns the fingering-to-note relationship, the three-circle symbol is replaced by the conventional notings on the staff.

A second use of geometric instructions that the inventor has found is in the technical reference manual for a three-button PC mouse. Throughout the manual there are pictorial references to three small squares where one or more of the squares are darkened to convey to the user that he or she should press the corresponding button(s) on the mouse to cause the desired action. After learning the desired process, the user discards the reference and "clicks" by memory.

SUMMARY OF THE INVENTION

It is one object of this invention to allow a user with only a limited knowledge of music to immediately play an instrument at a moderate-to-advanced level;

It is another object of the invention to provide an electronic musical instrument with improved ease of use;

It is another object of the invention to provide an electronic musical instrument wherein many modes of play and musical notations may be simply activated;

It is a further object of the invention to provide a notational symbology integrally related to a new musical instrument, the combination providing greatly enhanced ease of use and flexibility; and It is another object of the invention to provide a musical instrument of reduced complexity through probabilistic selection of chords available to the instrument.

Primary features of the invention include a new musical notational scheme, new methods of interpreting the finger activations of a user or musician, and associated new electronic musical instruments. Research into the occurrences of chords in popular music in particular keys has led the inventor to two discoveries: chord types should be assigned, not on perceived need for universal chord availability, but on the actual need for the chords in the music to be played; and secondly, that distinct positions for each of the 12 roots are not necessary. The invention proceeds on the concept of making available to the user, not all possible chords, but the chords that are needed for a particular song or for a group of particular songs. This frees one from the constraint of having, for example, only seven chord types. Complicated chords are made available as needed. For example, in some songs, if assumed to be played in the key of C, a G7 Sus 4 is needed to complete the feel of the song. This invention allows such a chord to easily be included in the chord definition set.

The musical instrument includes a number of user-activated sensor areas. In the preferred embodiment, the notational scheme is displayed on a selected surface and instructs the user which sensor areas to activate on the disclosed special electronic musical instrument and, in various embodiments, are located so that they can be manipulated without any substantial lateral arm/hand movement. The sensor means may select notes, chords, or other musical events. In particular, a chord selection means is provided which can be manipulated or accessed without substantial lateral arm/hand movement, as opposed to being spread out over 12 positions. The sensor areas, as well as conventional keys and a programmed microprocessor within the preferred instrument, allow interpretation of the user's activations, and further cause the generation of control signals for use by an internal and/or external sound generation means to produce the desired musical results.

The notational scheme is novel in that it directly relates to the sensor areas or keys of the disclosed instrument, and thus requires minimal mental translation by the user from notation to implementation. Several different playing modes are provided, ranging from a "single-hand" mode to "two-hand" modes that use an auxiliary set of conventional keys to augment the selected musical events.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

FIG. 2 is a schematic diagram illustrating a notational scheme according to the preferred embodiment;

FIG. 3 is a schematic diagram illustrating a notational scheme according to the preferred embodiment;

FIG. 4 is a schematic diagram illustrating a notational scheme according to the preferred embodiment;

FIG. 5 is a schematic diagram illustrating a notational scheme according to the preferred embodiment;

FIG. 9 is a table illustrating structure and operation of the control generation means according to a preferred embodiment;

FIG. 15 is a table illustrating structure and I operation of embodiments employing a probabilistically-selected chord set;

DETAILED DESCRIPTION OF THE PREFERRED EMBODIMENTS

The following description is provided to enable any person skilled in the art to make and use the invention and sets forth the best modes contemplated by the inventor of carrying out his or her invention. Various modifications, however, will remain readily apparent to those skilled in the art, since the generic principles of the present invention are disclosed with respect to various embodiments exhibiting readily implementable and commercially advantageous aspects.

Direct Translation Notation and Corresponding Key or Sensor Means

Conventional musical notation can be viewed as indirect instructions to a musician as to how to manipulate his or her chosen instrument in order to produce the desired musical results; "indirect" in that the musician must mentally translate the paper notation into corresponding required physical actions before proper results can be achieved. Such translation and physical movement, as previously noted, has been a source of frustration to would-be musicians who have tried to learn to "read" music. A key, therefore, to the successful operation of the preferred embodiments, is the capability of presenting sets of musical symbols to a user, where the symbols are directly related to the physical actions that the user must execute in order to properly play the song. Such a direct relationship between the printed notation and the physical actions avoids the frustrating translational problems that have plagued conventional musical notation. The purpose of direct translational notation, in the simplest terms, is to accurately and concisely instruct the user what button, key, or sensor to physically manipulate, and just how that manipulation should physically be done to produce the desired musical results, without the intervening mental translation.

To better understand this new notational scheme, consider how operational instructions have been presented for electronic devices in general. Consider that it is desired to have a user depress a certain button on an electrical control panel. The most basic method, for example, would be to print the instructions "press the leftmost button firmly." Another example method would be to show a picture of the buttons, and draw an arrow to the leftmost button with the printed instruction "press this button firmly." Such written instructions, although quite precise, are not quickly interpreted, nor do they lend themselves to presenting multiple sequential instructions in a concise manner, as the playing of a musical instrument would require.

FIG. 2 shows a first type of directly translational "instruction set" for musical notation according to the preferred embodiments.

Figure 1:
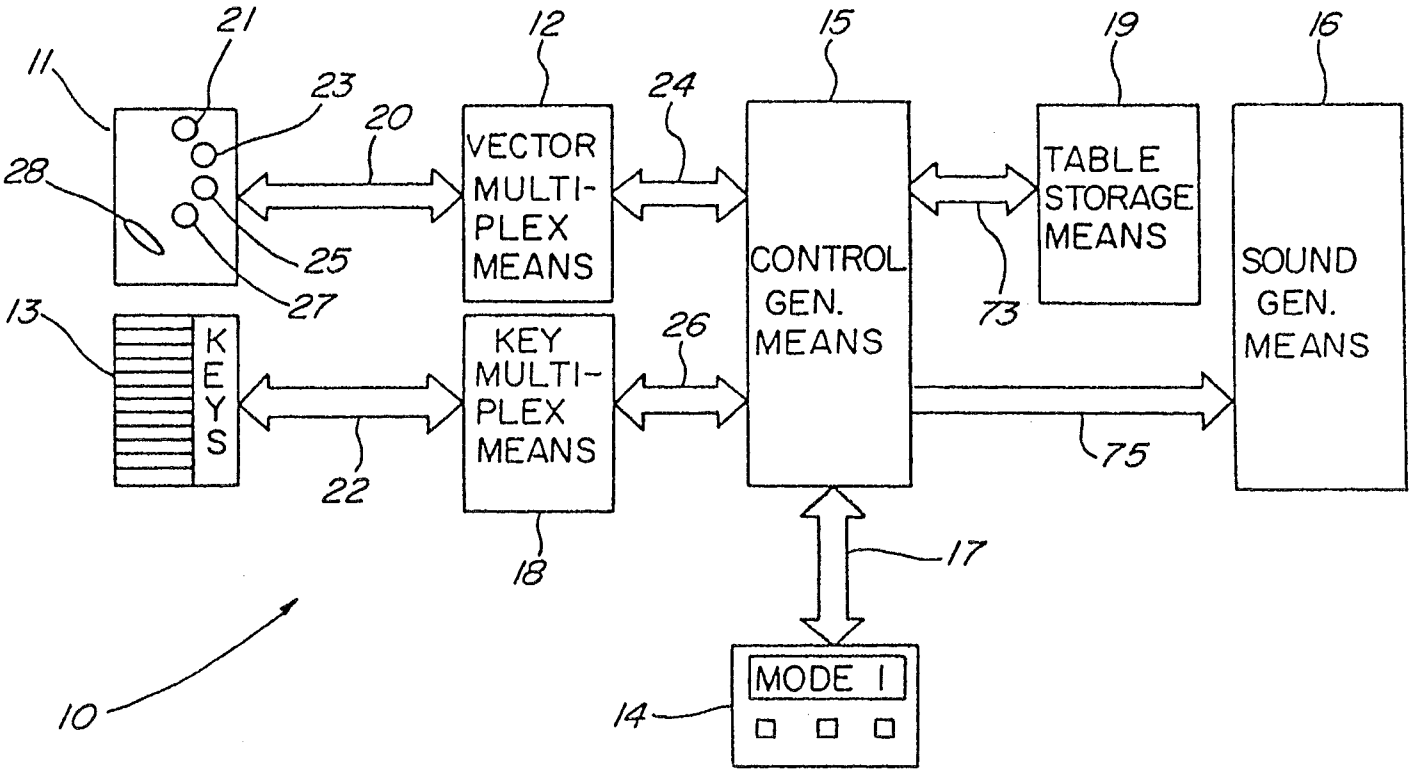
FIG. 1 is a system block diagram of the preferred embodiment.

Consider that the four circles 101 shown in FIG. 2 are presented on a sheet of music (several times smaller) as a notational symbol 103, and that the user has been instructed that each of the four circles 101 corresponds one-to-one to the four physical sensing areas 21, 23, 25, 27 shown in FIG. 1. Further, the user is instructed to locate the tips of the four fingers of his or her left hand over the four physical sensing areas 21, 23, 25, 27, and one finger over each area 21, 23, 25, 27. Each of the four circles 101 of a symbol 103 can be "blank," as shown in FIG. 2, but in use, one or more of the circles within the set of four circles 101 can be blackened, or otherwise modified, to distinguish it from other unmodified circles. Consider further, that such modification of the circles 101 is interpreted by the user as meaning "press down firmly on the sensing area 21, 23, 25, 27—that is under the finger that directly corresponds to the physical position of the blackened circle in the notation." For example, in FIG. 3, symbol 102 conveys to a user (assuming he or she is using his or her left hand) that he or she should depress the sensing area that is under his or her forefinger. Symbol 104 of FIG. 3 conveys to the user that he or she should depress two sensing areas, particularly those which are under his or her ring finger and under his or her forefinger.

There are a total of 15 different combinations of finger depressions (not counting the "none depressed" state) available to the user. These 15 different combinations, along with the "none depressed" state, are all shown in FIG. 3. With very little practice, a user can quickly interpret such a notational scheme when presented sequentially on a sheet of music, and accurately depress the appropriate sensors or switches 21, 23, 25, 27 using this precise, concise musical "instruction set."

If software in the control generation means 15 interprets these 15 combinations of fingerings as 15 chords, for example, then a user, following properly notated sheet music, can cause corresponding chords to be produced from a properly programmed sound generation means 16. The appropriate chords can sound for as long as the user keeps the corresponding combination of sensors 21, 23, 25, 27 depressed and then decay in a previously-determined manner when the sensors are "released" to the "none depressed" state.

It was previously thought that 15 chords would be an insufficient number for a practical instrument affording a reasonable degree of playing flexibility and enjoyment. However, the inventor has discovered that if 15 chords are selected on the basis of the most probable occurrence of chords in popular music, a useful instrument can be achieved. Embodiments employing a probabilistically-selected set of chords and companion musical instrument are disclosed below in conjunction with FIGS. 14 et seq. (FIG. 15 is the chord set chart). Fifteen chords are sufficient for any particular song, and the same 15 chords may be valid for several songs. With the capability provided according to the preferred embodiment of selecting from among a number of 15-chord sets, virtually all popular songs may be played. Further, this inventor has found that a single set of 30 chords is sufficient to cover almost all popular songs without resorting to selection between chord tables. Note that jazz may require either some different chords from those used for popular music or different sets of chords.

The 15 combinations produced by this method can be increased to 31 combinations by adding a fifth circle to the symbol 103, the fifth circle being located on a common centerline with the other four circles, and adding an additional sensor to be activated by the thumb. However, the inventor has found that such an apparent small increase in complexity creates a dramatic increase in difficulty for the user, in terms of speed of interpretation. That is, having five common centerline circles presented to the user, corresponding to the user's four fingers and thumb, limits the speed at which the user can "read," decode, and execute the codes. Therefore, the thumb, when used with such symbology, would be assigned to less frequently used chords or, more appropriately, to only control functions.

While five aligned circles prove relatively difficult to read, further research has shown that dropping the fifth or "thumb" circle below the centerline, or otherwise breaking the continuous alignment, of the other four circles results in a symbol set which is readily interpreted by the relatively novice user. Such a set is disclosed in FIG. 15 with a corresponding set of five keys. Such a symbol set may be used to generate the 31 most probable chords, as discussed below in more detail.

FIG. 4 shows an expanded symbol 106 having three sets 107, 108, 109 of four circles, e.g. 110, stacked on top of each other (again, the symbol 106 is illustrated several times larger than needed). The surprising result is that, in the face of the previously-described difficulty of using five circles aligned in a row for a symbol set, users can easily read three sets of the four-finger symbols. Only one row, e.g., symbol 107, is used at a time, as if it is the only symbol set. By observing the three-tiered symbol 106 on sheet music or another surface, the user can stay on the "home set" 108 in the center, or move up to the top four-circle symbol 107 or down to the bottom four-circle symbol 109 and execute the required fingerings. Cross-fingering (depressing buttons in more than one row at the same time) is possible, though more difficult, and increases the number of possible chords.

The expanded symbol 106 gives 45 combinations (three sets of 15 combinations) which, when used with electronic transposition, is more than adequate for almost all popular songs. During analysis of several books of songs, this inventor found that only 28 different chord types appeared in the songs when each song is transposed to the key of C. Since all synths can be made to play in any key while actually playing in the key of C, a wide range of songs can be played through a relatively simple key set and notation. Supplying 45 chords to the user provides more than the 28 required for popular songs.

The inventor has further found that a user can, with only slightly more difficulty, read a symbol that is three rows of six circles each. The six-circle approach allows the user from the "home" position to go up, down, right, left, up and right, up and left, etc., while still using only four fingers. This approach, however, creates a symbol set with a much more difficult learning curve. An embodiment employing such a symbol set is discussed in more detail below in conjunction with FIGS. 17–19. The symbol set can be any of many shapes, including geometric shapes such as circles, squares, etc., or graphical symbols such as valves, keys, or even pictures of fingertips with alterations to convey activation or nonactivation.

While such symbols provide adequate coverage for most musical applications, a desire to simplify hand movement requirements, while providing even more power, led the inventor to the concept of micro vector notation which will now be described.

Just as the inventor has found that a user can accurately depress one of four keys, or sensing areas, by observing the just-described four-digit notational symbol, he has also found that a user can also very easily execute more powerful movements on appropriate keys or sensing areas. (Assume for the following descriptions that only the four-circle symbol described earlier is now being considered.) For example, instead of just pressing down on one of the four sensing areas 21, 23, 25, 27, the inventor has found that a user can easily be instructed to produce directional pressure with his or her finger on a sensing area as he or she presses downward on the key. For example, the user can be instructed to exert directional pressure with his or her finger "toward the right" or "toward the left," etc. The directional exertion of pressure by the fingers on appropriate sensing surfaces as downward pressure is applied is referred to by the inventor as "micro vectors." The inventor has found that a user can quickly adapt to instructional symbols that call for eight different directions (vectors) of pressure to be applied to the four sensing areas 21, 23, 25, 27 as long as all fingers which are applying pressure apply such pressure in the same direction for each of the eight vectors.

These eight simple vectors have also been found to be easily notated on sheet music, and decoded by the software resident in the means 15. These eight vectors, if described as vector quantities within a small square sensing area, would respectively describe pressure as: (1) from top to bottom, (2) from bottom to top, (3) from right to left, (4) from left to right, (5) from lower left to upper right, (6) from upper right to lower left, (7) from lower right to upper left, or (8) from upper left to lower right. Note that simple downward pressure is also available.

There are also additional simple vectors that could be executed, even though they may be more difficult due to the precision required of the user. An example of such a vector would be pressure from one direction to another, followed by a quick reversal (a "wiggle"). It should be kept in mind that for a given vector, all involved fingers draw the same vector. For example, one micro vector would be only the forefinger pressing upward. Another micro vector would be the forefinger and the little finger both pressing downward. Another micro vector would be all four fingers pressing "northeastward." The number of "involved" fingers would range from one to four, as in the previously-described 15 fingering combinations. Given the 15 combinations of how four fingers can touch four sensing areas, the eight directions, plus the 15 downward pressure combinations that the simple micro vectors can assume, 135 different micro vector combinations can be achieved for use in musical control, without the user moving his or her hand away from one selected sensing area. Note again that the user is typically required to press all involved fingers in only one direction at a time to generate a given micro vector. However, certain sensing areas can be manipulated in different directions, if desired. For example, pressing upward with the forefinger while pressing downward with the middle finger would create a different, albeit difficult, micro vector.

Given that it is known that 135 simple micro vectors can be physically created, there is then a requirement to notate such micro vectors in a set of concise symbols, in order to appropriately "instruct" the user. An example of a set of such symbols is shown in FIG. 5. Here, in addition to the four circles previously shown selectively blackened for the "pressure only" notation, in this new scheme, each of the user's four fingers, and therefore each corresponding micro vector sensor 21, 23, 25, 27, each located respectively under one of the user's four fingers, is represented by four geometric shapes which contain directional indicators. For example, if the chosen geometric shapes are squares, an arrow or other directional indicator is placed inside each of the squares. The arrow represents one of the eight possible directions that the micro vector is to take. For example, in FIG. 5, a symbol 201 denotes to a user that he or she should make a micro vector in the downward direction, using both his or her ring finger and his or her middle finger. A second symbol 202 denotes to a user that he or she should make a micro vector in the "rightward" direction using his or her forefinger. A third symbol 203 denotes to the user that he or she should make a micro vector in the "northeastward" direction using all four of his or her fingers. Again, a total of 135 different possible combinations are possible: 15 different combinations of fingers drawing a single vector, and nine different vectors that can be drawn (including the "pressure only"). Other examples of micro vector combinations 204–208 are also shown in FIG. 5.

Those skilled in the art will appreciate that numerous approaches can be taken to drawing the symbol set, the directional indicators, as well as the selection of the vectors used, can be taken without departing from the novel concepts of this invention. For example, the symbol set could be a set of octagons, with some alteration made to one of the octagonal sides to indicate vector direction. Triangles could be used and rotated as appropriate for the required vector. As noted earlier, more complex vectors can be notated and conveyed to expand the number of control possibilities. The simpler-appearing arrows were chosen as the preferred embodiment because they are easy to hand notate, are easy to print, and also lend themselves to the more sophisticated symbols, if required. Further, more than one set of symbols can be presented on the sheet music or other surface such as a CRT or other display. Symbols could also be programmed or stored on various memory media and automatically inputted, if desired.

We know that in conventional notation a particular note, located with reference to certain lines of the staff, represents one, and only one, note, and that a particular piano key generates one and only one note. However, by proper software control, the vector notations can be caused to represent any number of musical events such as individual notes, chords, or modulation effects, and may be changed at any time by the user, if desired.

In one configuration according to the preferred embodiment and discussed in more detail below, micro vectors cause chords to be selected and played by the system 10. As noted earlier, 135 chords could be made available to the user and assigned to any of the 135 fingering combinations. Assigning the most highly used chords to single finger combinations performing the simplest movements (up, down, right, left) allows ease of use. The next most highly used chords desirably uses two-finger combinations with the simplest movements, etc. When the user is presented sheet music that has the proper notation, he or she can select any song and play the chords in tempo whether the song is familiar to him or her or not. This "single-hand" mode for chord generation is a preferable mode for a beginner. This mode, however, is only one of many modes which allow the user to realize music growth and power with the instrument. Such modes will be described in more detail later.

Micro Vector System

FIG. 1 illustrates a micro vector system 10 according to the preferred embodiment. Micro vector notational sheets are not shown in FIG. 1, but they are an important part of the system 10 and will be explained in detail below.

The system 10 comprises a micro vector sensor means 11, a vector multiplex means 12, key multiplex means 18, augmenting keying means 13, mode control input means 14, control generation means 15, table storage means 19, and a sound generation means 16. The micro vector sensor means 11 includes five physical sensing areas or sensors 21, 23, 25, 27, 28. Electronic synthesizers and electronic organs, for example, are viable sound generation means. They are well-known to those skilled in the art and are readily available commercially from numerous sources.

The system 10 allows a user to quickly and easily read and play music at an advanced level. The foregoing "system description" is product independent. That is, the notational, sensing, encoding, and control technology may be applied to a variety of product implementations including being built into conventional keyboards, used with personal computers, developed as a special controller, or incorporated into toys, etc. The following is a more detailed description of each of these elements.

Micro Vector Sensor Means

Given the above description of the micro vector "instruction set" illustrated in FIG. 5, the features of the preferred set 13 of four sensors (or switches) 21, 23, 25, 27 to implement the physical detection of the vectors become clearer. The sensing areas of the four sensors 21, 23, 25, 27 have a surface area large enough to allow the fingers to generate the micro vectors comfortably, yet close enough to allow all four fingers of the user's hand to simultaneously access all four of the sensors or switches 21, 23, 25, 27. The technology for the switches 21, 23, 25, 27 should be such that any physical movement ("travel") does not impede the micro vector techniques, i.e., the sensing areas should have a "feel" to allow some "give" for the user's finger when pressure is being applied. The fifth sensor, 28, is preferably available for the left-hand thumb for modulation control of the musical outputs.

Other methods, such as multiple miniature joysticks or capacitance sensors, could be used to implement the requirements for sensors or switches 21, 23, 25, 27, 28. That is, the generally available joysticks used for games and computers can be made "spring-loaded" such that the control lever always returns to a center position. As such, the joystick can be used to output signals indicative of the direction that the control level is being pushed. By miniaturizing such joysticks such that they could be placed with the control levers one inch apart, these joysticks could be used as micro vector generation means. Also, capacitance sensors that could detect small movements of a finger on its surface and give XY signal outputs could also be used for the sensor means.

The preferred embodiment uses a so-called four-quadrant force sensing resistive sensor available from Interlink Electronics, Santa Barbara, Calif. These sensors can be manufactured in custom sizes, and have the capability of detection of not only finger pressure, but the detection of the direction of that pressure as well, with the addition of appropriate key caps placed on the sensors and appropriate interface circuitry. The characteristics of these sensors make them ideal for the subject application because they have a high sensitivity to touch, with barely perceptible travel due to their membrane-type construction.

The four sensors 21, 23, 25, 27 are placed adjacent each other on the instrument, or on some other panel, as shown in FIG. 1. A one-inch center-to-center spacing between adjacent sensors, e.g., 21, 23, can be used, similar to that found between keys on a conventional piano keyboard. A slight curvature to the placement of the sensors 21, 23, 25, 27 helps compensate for differences in finger lengths of users, as well as for the variations in the size of hands from user to user. A small tactile separator (not shown) between the four areas, or slight concavity of the cover key cap may be provided to allow the user to maintain alignment of his or her fingers in the proper areas without constant visual attention.

Figure 6:
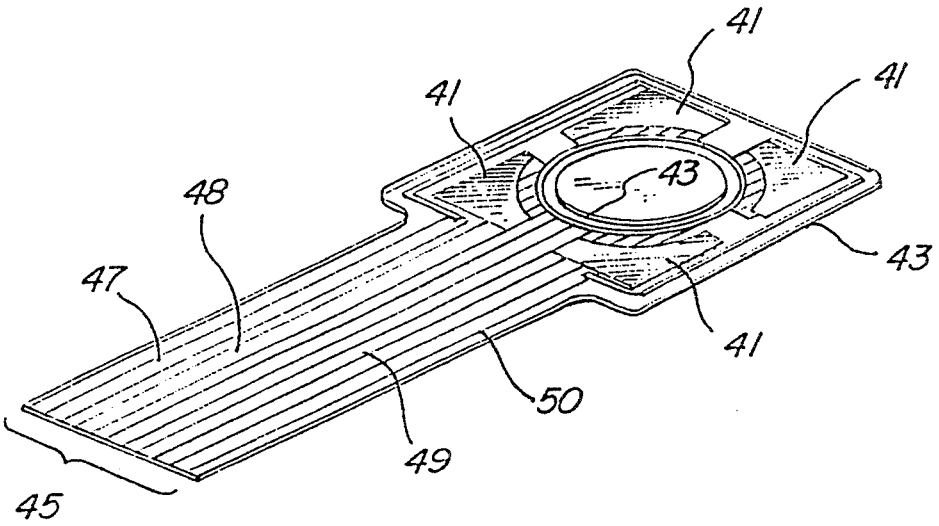
FIG. 6 is a perspective view illustrating a sensor pad of a sensor switch according to a preferred embodiment.

The physical structure of the four sensors 21, 23, 25, 27 (and optional thumb sensor 28) will now be discussed in more detail. Each of these sensors 21, 23, 25, 27, 28 has four pressure-sensing areas 41 placed strategically onto a ¾-inch-diameter circle 43, as shown in FIG. 6. The sensing areas 41 have a membrane-type construction with special conductive ink and electrically isolated comb-like conductive fingers printed onto a substrate 42. When pressure is applied, the conductive fingers are pressed into the special ink, and a resistance change is seen at the output connections 45. Four sets of connections are made available per sensor, one set per sensing area.

Figure 7:
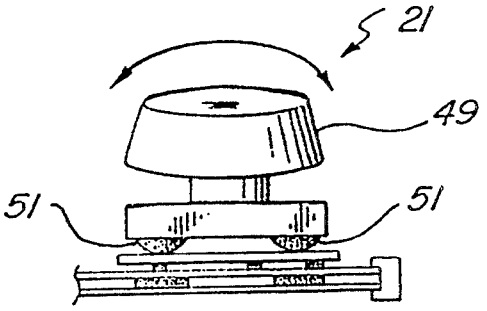
FIG. 7 is a front view of a sensor switch according to the preferred embodiment.

As shown in FIG. 7, a special keycap 49 is placed on top of the sensors, e.g., 21. This keycap 49, similar to a conventional PC keyboard keycap, has four special "feet" 51 on the bottom which rest on top of the four special sensing areas 41 of the sensor 21. The keycap 49 is physically constrained to prevent rotation and to maintain contact with the rest of the device by a panel cover (not shown). The keycap 49 is approximately ½-inch in height. If a user presses directly downward onto a keycap 49, then each of the four sensing areas 41 of the sensor 21 will sense the pressure and show a decrease in resistance via the output connections 47, 48, 49, 50. If a user imparts directional pressure, as in a joystick-type operation, onto the sensor 21, then some of the four sensing areas 41 will be pressed more than others. Therefore, the resistance values of the four sensing areas 41 will be correspondingly different. By sequentially observing the four resistance values with appropriate circuitry, one can calculate the direction of the applied pressure. Unlike joysticks which may have an "infinite" number of output values, the control generation means 15 will "round off" outputs to give an indication of one of eight vectors that is "closest to" the outputted values. Each of the four outputs 47, 48, 49, 50 of each of the four sensors 21, 23, 25, 27, 28 is connected to the vector multiplex means 12, as shown in FIG. 8.

Interface circuitry (FIG. 8) is associated with each particular sensor 21, 23, 25, 27 and may be considered part of the sensor means. The interface circuitry is connected to the four discrete pressure-sensitive areas on each of the sensors 21, 23, 25, 27. The interface circuitry provides signal outputs which define how each of the sensing areas have been depressed, and therefore enable the derivation of signals indicative of the directional pressure of a finger on the "cap" 49 of the switches 21, 23, 25, 27. The micro vector multiplex means 12 receives these signal outputs and generates information used by the control generation means 15 to instruct the sound generation means 16 of the system 10, as hereafter discussed in more detail.

Figure 8:
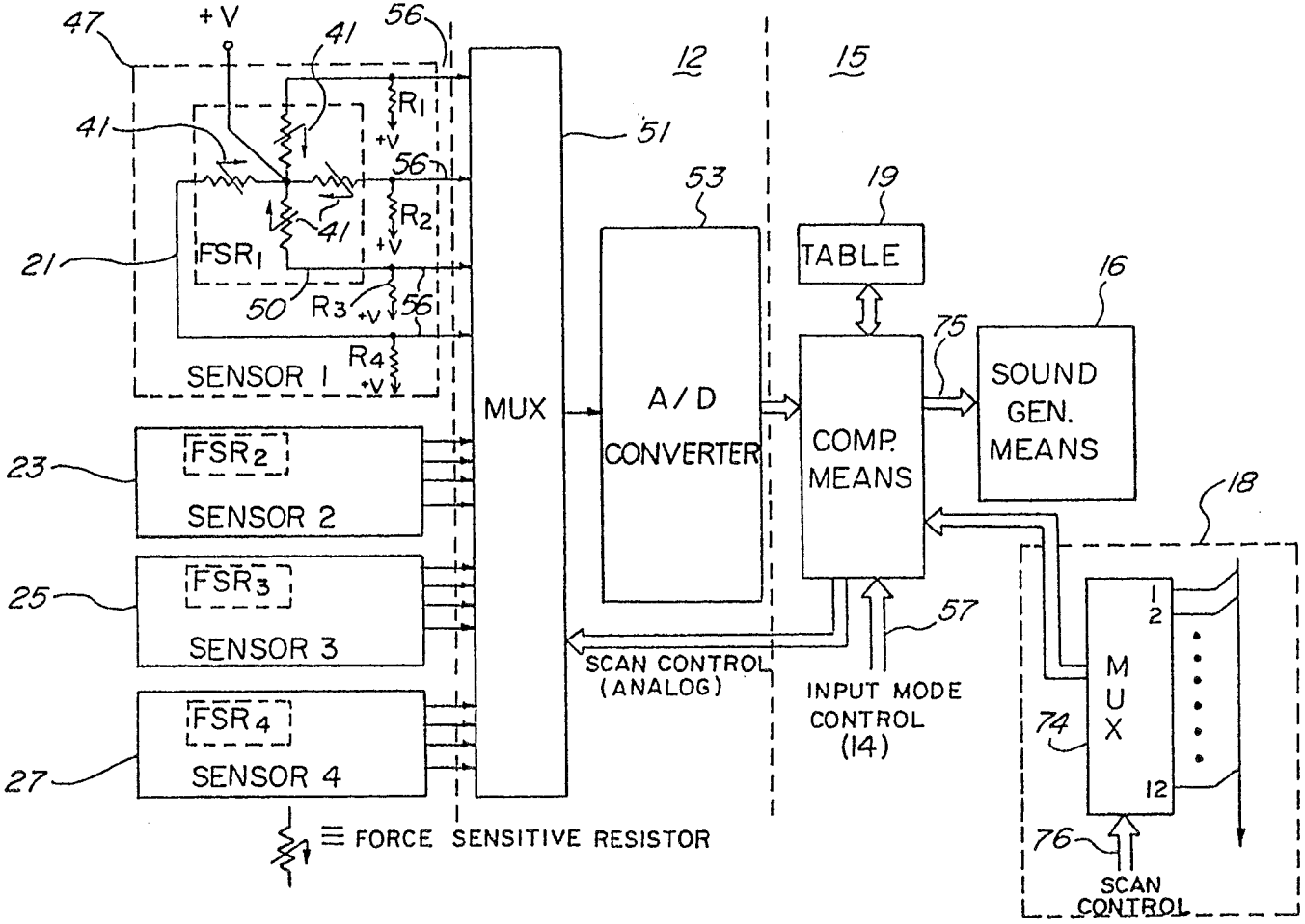
FIG. 8 is an electrical schematic drawing illustrating the preferred embodiment.

The simplest method of implementing the interface circuitry 55, shown in FIG. 8, is to create a voltage divider using a fixed resistor, e.g. $R_1$, with a first terminal connected to ground potential and a second terminal connected to a positive potential +V. The output terminal 47 of the variable sensing resistor 41 is connected to the second terminal of the fixed resistor $R_1$ such that the variable sensing resistor operates as a "pull-up resistor" between the second terminal of the fixed resistor and the positive voltage potential +V in a manner well-known to those skilled in the art. As the variable sensing resistor 41 is depressed, the voltage at the common junction of the two-resistor voltage divider just described will vary from the positive voltage potential (when the variable sensing resistor 41 is depressed and, therefore, small resistance) to almost 0 volts (when the variable sensing resistor 41 is not depressed and has a very high resistance).

Micro Vector Multiplex Means

The vector multiplex means 12 shown in FIG. 8 includes a multiplexer 51 and an analog-to-digital ("A/D") converter 53. The multiplexer 51 accepts the connections 56 from the 16 sensing areas (four sensing areas on each of the four sensors 21, 23, 25, 27).

By applying the varying voltages supplied by the interface circuitry to the A/D converter 53, data suitable for inputting to a programmed computation means 57 or personal computer is obtained. By using analog multiplexing techniques well-known to those skilled in the art, the voltages from all 16 of the sensing areas are successively presented to the single A/D converter 53 for further use by the computation means 57. Control data from the computation means 57 is applied to the aforementioned multiplexer 51 to direct the A/D converter 53 to access the desired one-of-sixteen sensing voltages, again in a manner well-known to those skilled in the art.

The computation means 57 must analyze the voltages presented to it in digital form by the A/D 53 and derive a "best fit" output that most closely reflects the direction of the pressure exerted on a particular pad or pads by the user. This computational process is as follows. Each of the four sensor areas 41 of each of the four sensor pads 21, 23, 25, 27 will generate a resistance inversely proportional to the pressure exerted upon it—high pressure gives low resistance. This resistance in turn is used to generate a voltage that is proportional to the applied pressure. Therefore we obtain four voltages, one from each sensor area 41, indicating the pressure applied to the corresponding sensor area 41. To be able to determine the vector direction from a particular sensor pad, e.g. 21, we must analyze all four of the voltages from that pad 21. Consider that each of the sensor areas 41 of a pad 21 is labeled "north," "south," "east" , and "west." Then even though we are pressing in a "northward" direction, there may be some pressure on each sensor area 41. Therefore the computation means 57 will subtract the north voltage from the south voltage and get a resultant voltage that indicates that the north voltage is substantially bigger than the south voltage. Then the computation means 57 subtracts the east voltage from the west voltage. In this example, the two should be essentially equal. In this manner, the computation means 57 determines that the correct vector is "northward." Note that if north was greater than south and east was greater than west, the computation means would conclude that the correct vector is "northeast," not north. To avoid ambiguity, the computation means 57 employs set thresholds that indicate how much greater east should be than west before we change the vector from "northward" to "northeastward." This operation is a straightforward software exercise.

Augmenting Keying Means

The augmenting keying means 13 of the preferred embodiment comprises 12 keys 61 which are similar to the white keys of a conventional keyboard. These keys 61 are activated by the user's right hand in cooperation with the user's left hand, which manipulates the four sensors 21, 23, 25, 27. Conventional "black keys" may be included for consistency with commercial keyboards. In some embodiments, 24 white keys (two octaves) can be used and may be advantageous.

Right-Hand Key Multiplexing Via Key Multiplex Means

The 12 right-hand keys 61 are sequentially monitored for activity. Activities of interest are: (1) when a key goes from nondepressed to depressed; (2) when a key goes from depressed to released (nondepressed); and (3) the steady state conditions of depressed or nondepressed.

Such sequential monitoring may be done using well-known multiplexing techniques, such as multiplexer 74, as shown in FIG. 8. Commercially-available chips support 16-to-1 multiplexing where the choice of one of 16 inputs is made via four select line inputs 76 to the chip. FIG. 8 schematically shows the 12 key/contact inputs 1 . . . 12.

Mode Control Input Means

The mode control input means 14 is the user interface for the system 10. The interface 14 may be realized with conventional pushbuttons, LCD displays and controls, or with an interface to a personal computer video display and keyboard. Such interfaces present the user with options for configuring the unit and obtaining status from the unit. The interface allows the user to respond to these options and to input information indicative of his or her choices. The various choices presented to the user comprise, for example, whether he or she would like the left-hand actions to cause sound generation or to remain silent; whether he or she wants the right hand to play bass or arpeggios or chords or some other musical event combination; what instrument(s) sounds he or she would like to use for the right- and left-hand keys; what chords or musical events he or she would like assigned to the fingering combinations of the left hands; what notes he or she would like assigned to the 12 keys of the right hand; as well as "bookkeeping tasks" such as storing, retrieving, naming, or modifying selections.

Such front panel or PC screen activities described are done using somewhat general procedures such as scrolled menu selections. For example, one available screen display (either LCD or CRT) may show selections such as "LEFT HAND=BASS" with "LEFT HAND" underlined with a "cursor" line. By depressing the Scroll Up or Scroll Down buttons, a user can cause the "LEFT HAND" to become "RIGHT HAND" (or other selections), and the display would read "RIGHT HAND=BASS." Then, by scrolling the cursor to the right and under "BASS," a user can again depress the Scroll Up or Scroll Down buttons and cause the "BASS" selection to become "ARPEG" (for arpeggio), or "CHRD" (for chord), etc. Pressing the Enter button would cause the desired display to be saved. Such activities and menu selections are used in many consumer and commercial products and are easily tailored for use on a variety of products to make a viable user interface.

Control Generation Means and Table Storage Means

The control generation means 15 resolves the inputs from micro vector multiplex means 12 into high level information comprising the following elements: what directional micro vector (out of 135 possibilities) was inputted by the user, how loudly is the user "playing" the instrument (by sensing not only the directions of the pressure, but the magnitude of the pressure), how long does the user want the resulting note or chord to be sustained (by observing when the sensors go to a "none depressed" state), and what modulation of the resulting sound does the user desire (by observing how the user "wiggles" the sensor after the initial vector generation). (Also responds to keying means 13.)

As shown in FIG. 8, the control generation means 15 comprises a computation means 57 which may include a microprocessor and various other electronic elements such as structured tables of notes, plug-in memory cards, and timers. It receives inputs 17 from the mode control 14, as well as from the key multiplex means 18 and the vector multiplex means 12, and orchestrates the generation of the sound generation control signals outputted on control lines 75 for use by the sound generating means 16.

The control generation means 15 is "table driven." That is, data necessary for composing the sound generation commands to the sound generation means 16 provided over lines 75 is stored in structured tables in the memory 19, and elements within the table are "pointed to" by the software based on activity that occurs on the left-hand sensors 21, 23, 25, 27 and right-hand keys 61. The memory may be of many conventional types, such as conventional chips or software registers created in a program such as BASIC.

The table-driven software structure is not only a convenient method for storing musical events, but is also speed-efficient as well. In musical systems, it is essential that the musical sound be produced quickly, following sensor or key activations. Having "precalculated" data stored in a table avoids calculations that may cause system delays.

The table (e.g. FIG. 9) can be viewed as a two-dimensional array. The line in the array to be used is "pointed to" by the left-hand fingering combination. The column in the array to be used is "pointed to" by a combination of the mode selected via mode control 14 and by the right-hand key activations. That is, a mode selection of "bass" points to a column area of 12 bass notes. Activation of one of the 12 right-hand keys selects one of those 12 notes. The mode selections, along with the right- and left-hand activations, create a table address. The contents of that address hold the musical event data. That addressed data is then formatted into appropriate command strings and sent to the sound generation means 16, where the musical sounds are created in response to the commands.

In basic operation, the computation means 57 sets up certain allowable activities (i.e., allowable table accesses) based on inputs from the mode control user interface 14. It then reads the sensors 21, 23, 25, 27 and the augmentation keys 61 in a cyclic manner, accesses appropriate table entries, and then formats, generates, and transfers predetermined commands to the sound generation device 16 to cause the sounding of corresponding notes synchronized to the operation of the keys 61 and sensors 21, 23, 25, 27 by the user. FIGS. 10–13 show flow charts for the computation means illustrative of its programming.

Figure 10:
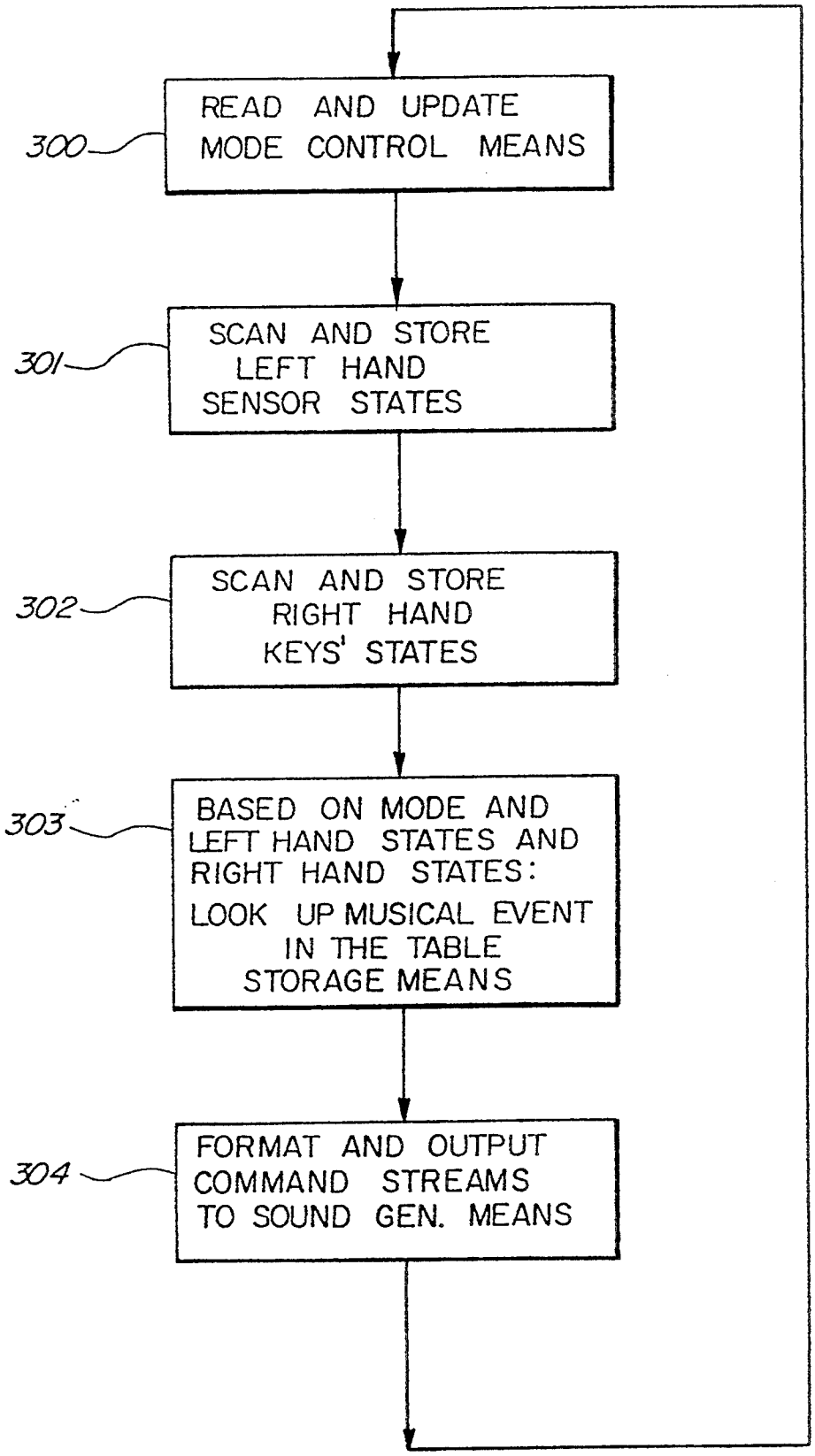
FIGS. 10–13 are flow charts illustrative of operation of the preferred embodiment.

FIG. 10 is an overall operational view or flow chart. In step 300, the computation means 57 reads and updates the mode control means status. In step 301, the computation means 57 scans and stores left-hand sensor states. In step 302, the computation means 57 scans and stores right-hand key states. In step 303, based on the mode, left-hand and right-hand states, the computation means 57 looks up the musical event in the table storage means. In step 304, the computation means 57 proceeds to format and output the stored command streams to the sound generation means 16.

Figure 11:
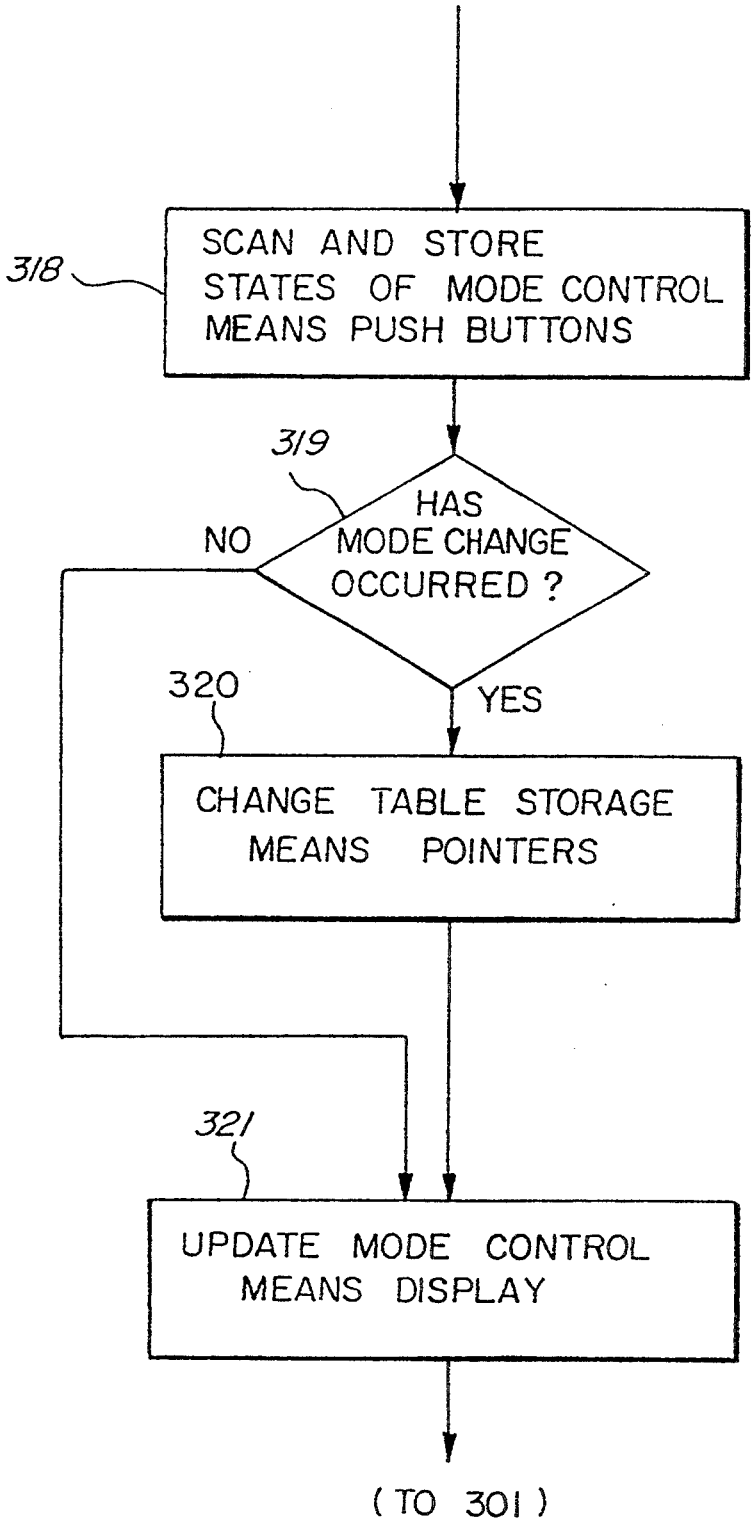

FIG. 11 illustrates flow details of the mode control status update 300. In step 318, the computation means 57 scans and stores the states of the mode control means pushbuttons. It then tests to see if a mode change has occurred, step 319. If a change has occurred, the computation means changes the table storage means pointers (step 320) and updates the mode control means display to effect the change (step 321).

Figure 12:
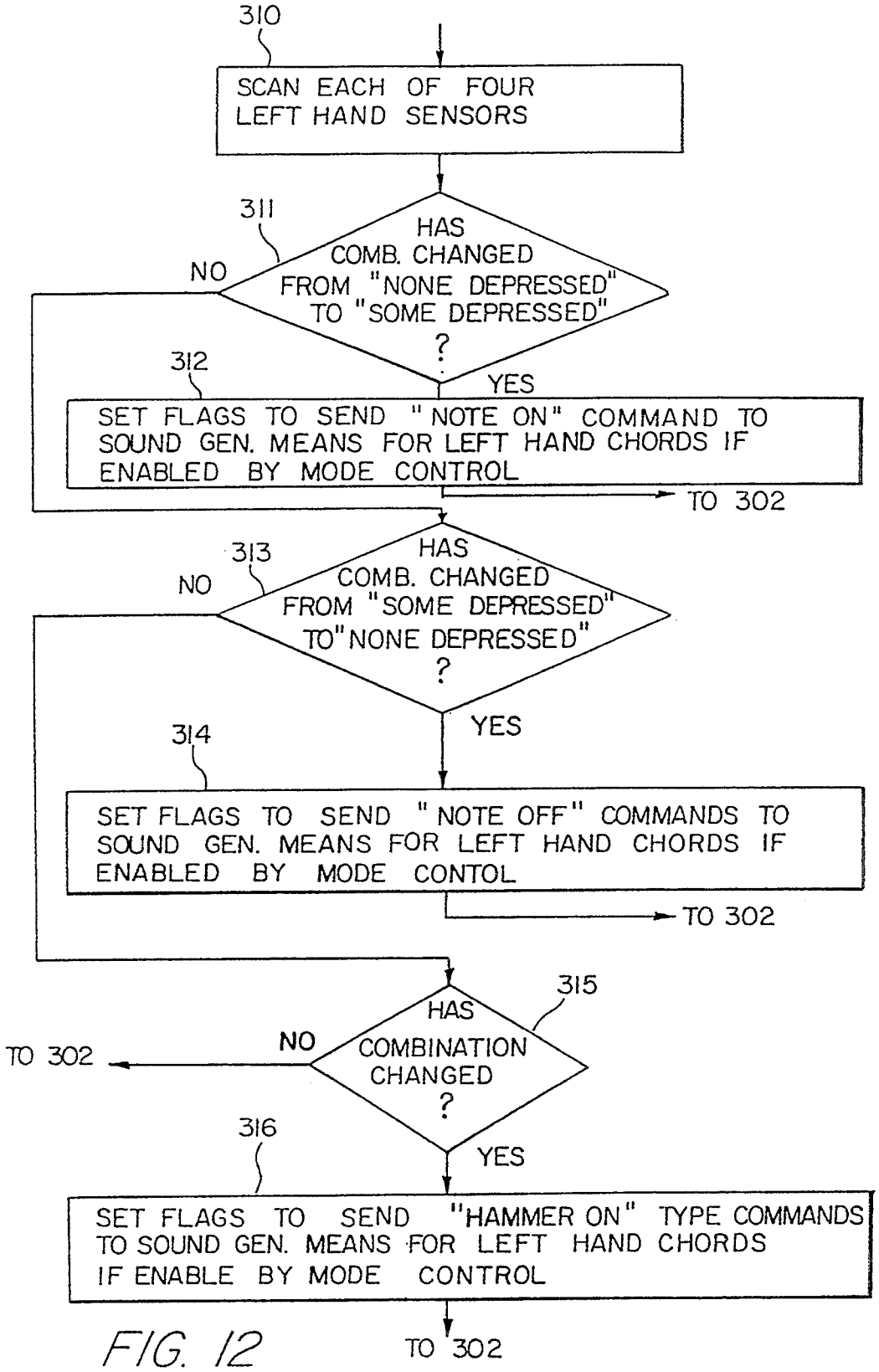

FIG. 12 shows details of the scan and store left-hand sensor states procedure 301. The flow enters step 310 from step 300. In step 310, the computation means 57 scans each of four left-hand sensors 21, 23, 25, 27. A test is performed at step 311 to determine whether the sensor combination has changed from "none depressed" to "some depressed." If so, the computation means 57 sets flags (step 312) to send "note on" commands to the sound generation means 16 for left-hand chords if production of such chords has been enabled via mode control 14. If the sensor combination has not changed in the manner tested for in test 311, a test 313 is performed to determine whether the combination has changed from "some depressed" to "none depressed." If so, step 314 is performed wherein flags are set to send "note off" commands to the sound generation means 16 for left-hand chords, if left-hand chords have been enabled by the mode control 14. If test 313 is not satisfied, the computation means 57 performs a test 315 to determine whether the sensor combination has changed. If it has, the computation means 57 sets flags (step 316) to send "hammer on" commands to the sound generation means 16 for left-hand chords if enabled by mode control 14. If not, the flow proceeds to step 302.

The preferred embodiment also incorporates the technique known in the art as "n key rollover." This is simply a delay that is used in situations where several keys may be activated at one time and "settling time" is required before making a final decision on the key's state. That is, when a key is first seen changing, a delay timer in the microprocessor is started. If another key is seen to change prior to the timer expiring, then the timer is restarted and other activations are awaited. As soon as the timer expires with no further activity, then the state of all the switches or sensors is taken as stable. This prevents the "chattering" that might occur if keys are going on and off asynchronously.

Figure 13:
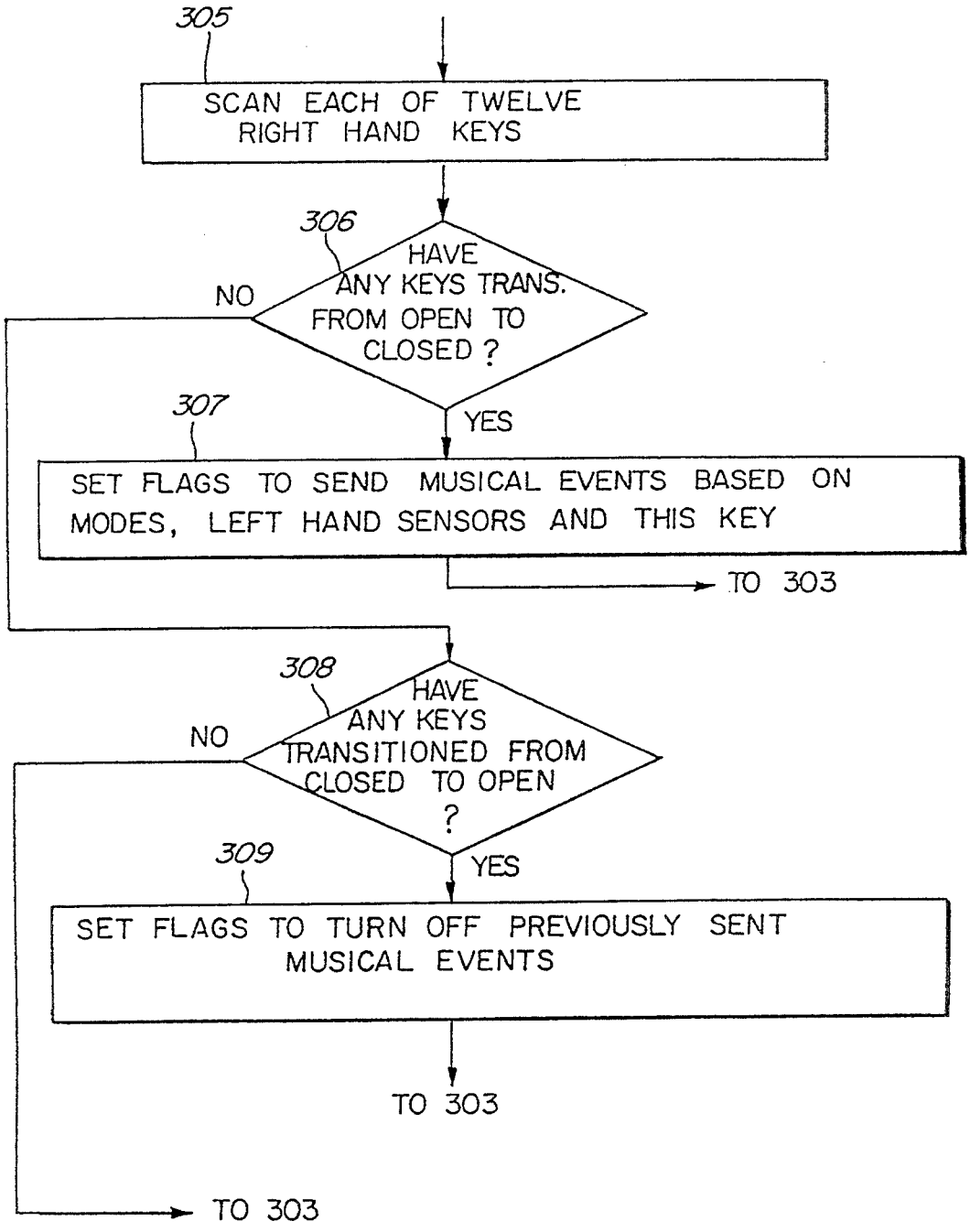

FIG. 13 shows details of the scan and store right-hand key states step 302 of FIG. 10. In step 305, each of 12 right-hand keys is scanned via the key multiplex means 18. A test 306 is performed to determine whether any keys 61 have transitioned from open to closed. If so, step 307 is performed wherein appropriate flags are set to send musical events based on the selected modes, left-hand sensors, and selected key instructions to the sound generation means 16. If not, test 308 is performed to detect whether any keys 61 have transitioned from closed to open. If they have, the computation means 57 sets the appropriate flags to turn off previously-sent musical events. If not, the flow proceeds to step 303.

An example of operation based on one particular selected mode will now be illustrated. For this example, assume the user has inputted information via the mode control input means 14 to configure the system such that operations of the left-hand sensors 21, 23, 25, 27 cause chords to be generated, and that operation of the right-hand key 61 causes complementary bass notes to be generated. Assume further that the user has chosen to use the 15 nondirectional combinations of the left-hand sensor activations to dictate the 15 chords shown in FIG. 9. (Other tables of chords are available for selection via the mode control means 14.) FIG. 9 then shows the details of a 15-element table that the control software is allowed to access under control of the four left-hand sensors 21, 23, 25, 27 and the 12 right-hand keys 61. (Note that in some cases, not all of the 12 right-hand keys 61 are used and, therefore, do not have notes stored.)

Specifically, if the user has just depressed a left-hand fingering combination of 0010, i.e., only the middle finger is depressed, then the software is pointed to the second line 332 of the table. Since this is a new left-hand operation, pursuant to step 303 of FIG. 10, the software proceeds to send out the notes of a chord. Looking at FIG. 9, it can be seen in line 332 under the heading "Chord" that there are four note signals that are sent out to the sound generator means 16 in response to the 0010 activation by the left hand. The notes are C, E, G, and C and comprise a C major chord. Pursuant to step 307 of FIG. 10, four "note on" commands are generated by the computation means 57 and sent to the sound generation means 16 to turn on the required notes, and thus cause the chord to sound.

Similarly, if the user were to release the left-hand pressures to "nondepressed," the computation means 57 formats and sends four "note off" commands to the sound generation means 16 pursuant to step 307 of FIG. 10. These "note off" commands cause the sound generation means 16 to cause the chord to decay off in a predetermined fashion.

During the time that the 0010 left-hand fingering is active and line 332 is being pointed to by the software, any activities by the right hand on the augmentation keys 61 cause additional notes to be generated. The table, under "Bass Notes," in line 332 of FIG. 11, shows the five notes available to the user for the right hand. For example, if the user depresses the left-most key of the 12 (or 24) right-hand keys, then the computation means 57 sends a lower octave C note "note on" command in a lower register to the sound generation means 16, and thereby causes a bass note to be sounded. Similarly, activation of the other notes of the right hand with the 0010 still activated sound other notes of a complementary bass pattern.

Notice that if the user switches from a 0010 pattern on the left hand to a 0001 pattern, for example, the available chord notes switch from those of line 332 under "Chord" to those notes of line 331 under "Chord." Therefore, on the initial activation of 0001, the computation means 57 sends out "note on" commands for G, B, D, and F notes, which comprise a G7 chord. The available right notes also switch to those of line 331 under "Bass Notes," namely the notes G, B, D, E, and F, which are complementary bass run notes for the chord G7. Similarly, any of the other combinations would "point to" one of the 15 lines in the Table of FIG. 11 and present the user valid notes for both the associated chord and the related bass notes.

In this "Bass Mode," playing the right-hand keys 61 in a linear sequence produces the programmed bass run. Changing chords with the left hand instantly selects the proper bass run that would "go with" that chord selection. Randomly playing right-hand keys produces different bass runs, but all selections fit perfectly within the musical context.

If the user had configured the system 10 to have no chords sounded when a left-hand combination was activated, then the same pointing to lines in the table would occur, except that the "note on" commands for the chord notes would not be issued by computation means 57. If the user had selected arpeggiation for the right hand instead of bass notes via mode control 14, then on a particular line, the computation means 57 looks under a heading of "arpeggiation" (not shown), not under the heading of "Bass Notes," to obtain the necessary note data.

The power of the instrument of the preferred embodiment becomes evident when considering the augmentating keying means 13. Various modes of operation selected via mode control 14 and implemented by use of the augmentation keys 13 are explained in more detail below.

One such mode referenced above is the arpeggiating mode. Assume the software of the system 10 is configured such that when the user inputs just the left-hand micro vectors, no sound is generated. This is not unlike an acoustic guitar, where merely fretting the guitar with the left hand does not cause any real sound to be generated. The guitar makes sound only when the player activates the strings by strumming or plucking with the right hand. Similarly, in this particular arpeggiating mode, the only way to create a sound is to activate one or more of the augmentation keys 61 in a prescribed manner. For example, in one variation of this mode, each of the 12 augmentation keys 61 is assigned one note of the chord that is currently being selected by the left hand. Therefore, by selectively playing one or more of the augmentation keys, arpeggios are generated where no wrong notes are allowed by the software! That is, every note on the right hand is a legal note of the chord selected currently by the left hand. As the left hand changes chords, the right-hand notes are "reassigned" by the software to that new chord. The left hand, if desired, can also sound the full chord by changing to another mode. Many different arpeggios (forward, reverse, inside out, etc.) of the chosen chords can be assigned to the right-hand keys 61 and would be stored in separate columns of the table.

Another mode is the scale mode. In this mode, the notes of a particular scale (major scale, diatonic, etc.) are assigned to the right-hand keys 61. Playing the right-hand keys 61 in a linear fashion produces the programmed scale for the particular chord selected by the left hand. Via switches 21, 23, 25, 27, the software selects the proper variation of the selected scale as various chords are selected by the left hand, allowing sophisticated improvisational techniques.

Other modes allow the right-hand keys 61 to be assigned to cause the selected chord, or one of its 12 inversions, to sound by merely playing only one of the 12 right-hand keys 61. That is, this mode, instead of playing one note per activation of a right-hand key 61, plays several notes per key activation. Another mode assigns bass notes to the lower three keys, e.g., $K_{11}$, $K_{12}$, $K_{13}$ of the right hand and chords to the upper eight keys $K_1 \ldots K_8$, and therefore allows the user to select a chord with the left hand and play limited bass notes and syncopated rhythm with the right hand, merely by striking the appropriate augmentation keys in the proper sequence with his or her right hand, much like a guitar is strummed. In any of these modes, a user can also choose to have the micro vector chords (left hand) sounded in addition to these augmented notes that would be sounding under control of the right hand.

Other, less "traditional," modes are also possible. A particular selection with the left hand, with or without the right hand, can be programmed to cause a multinote sequence to "kick off," for example. Note combinations, too complex or too fast for normal playing, would be straightforwardly performed with this instrument. Other left-hand combinations could be used to initiate drum patterns or fills. Sequencers that are currently available commercially, such as the Korg PSS60, can be controlled by this device to cause the sequencers to track the chords selected by the left hand, and therefore generate multipart sequences.

In summary, there are a number of "modes" that can be supported by the disclosed invention. From a user's point of view, some of these include:

- Pressing only the left-hand sensors, many chords may be generated.
- Pressing only the left-hand sensors, an automatically-playing musical sequence may be caused to shift to different chords.
- Pressing right-hand keys can play bass notes.
- Pressing right-hand keys can play full chords.
- Pressing right-hand keys can play arpeggios.
- Pressing a right-hand key (a single key, or any of several designated keys) can cause a sequence of notes to be played out, one at a time, corresponding to each key activation.
- Pressing a single right-hand note can cause multiple notes to be sequenced out. This could be a triplet, for example, for each key press, or a strum-like sequence.
- Any combination of the above, assigned to different sections of the 12 keys.

All of the above information can be conveyed to sound generation means 16 contained within the instrument or conveyed by Midi (Musical Instrument Digital Interface) to external sound generation instruments in a manner that is well-known to those skilled in this art.

It should be clear that the placement of the left-hand sensors 21, 23, 25, 27 and the right-hand keys 61 physically on the device is a matter of product preference. In fact, the 12 right-hand keys 61 may be absent and only left-hand sensors 21, 23, 25, 27 used; or the right-hand keys 61 may be a part of a conventional keyboard and may comprise more than or less than 12 keys; or the sensors 21, 23, 25, 27 and the keys 61 may be "remotely co-located" as part of a specialty controller and "connected" to the main unit via infrared, radio-frequency, or conventional wired signal transmission paths 20, 22 (FIG. 1).

Figure 14:
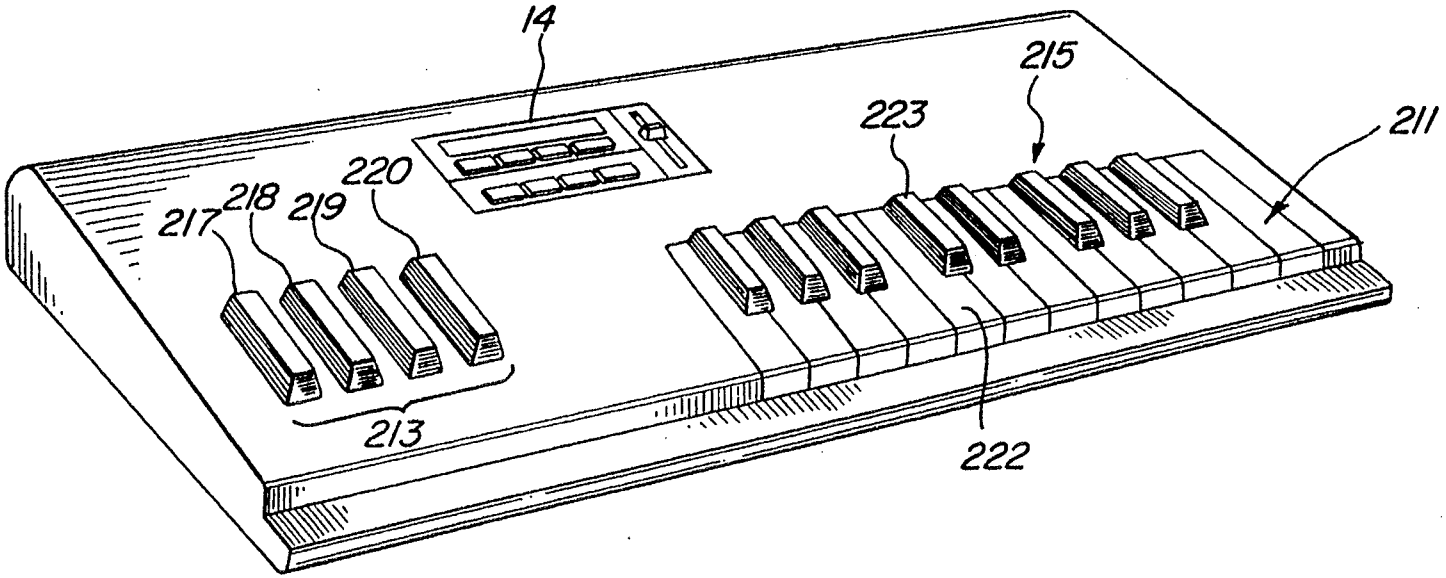
FIG. 14 illustrates a musical instrument according to the preferred embodiment.

FIG. 14 illustrates a keyboard 211 employing a first key set 213 and a second key set 215. In the particular embodiment shown in FIG. 14, the first key set 213 includes four keys, 217, 218, 219, and 220. Additional embodiments of the instrument of FIG. 14 employing additional keys or sensors will be described below. The keys 217–220, as well as the keys of various embodiments to be described, are located adjacent one another such that they can be activated by the user's fingers without lateral arm or hand movement of any significance. More particularly, in the preferred embodiments, the lateral arm or hand movement required is less than the width of one key to the right or left. These four keys are depressed in accordance with instructions provided by the symbology employing rows of four adjacent circles, i.e., circles whose centers all lie on a common line, as shown in FIGS. 2 and 3. The keys 217–220 are preferably depressible downwardly into the surface of the keyboard 211 similar to typical conventional piano keys. However, each of the keys 217–220 has a touch sensor located on the surface thereof which produces a binary-valued electrical signal indicating whether or not each of the respective keys 217–220 has been touched by a finger. The four electrical signals outputted by the electrical sensors of the respective four keys 217–220 provide 16 binary combinations from 0000 to 1111. This permits the selection of one of 15 chords by depression of various combination of the key set 213.

Figure 16:
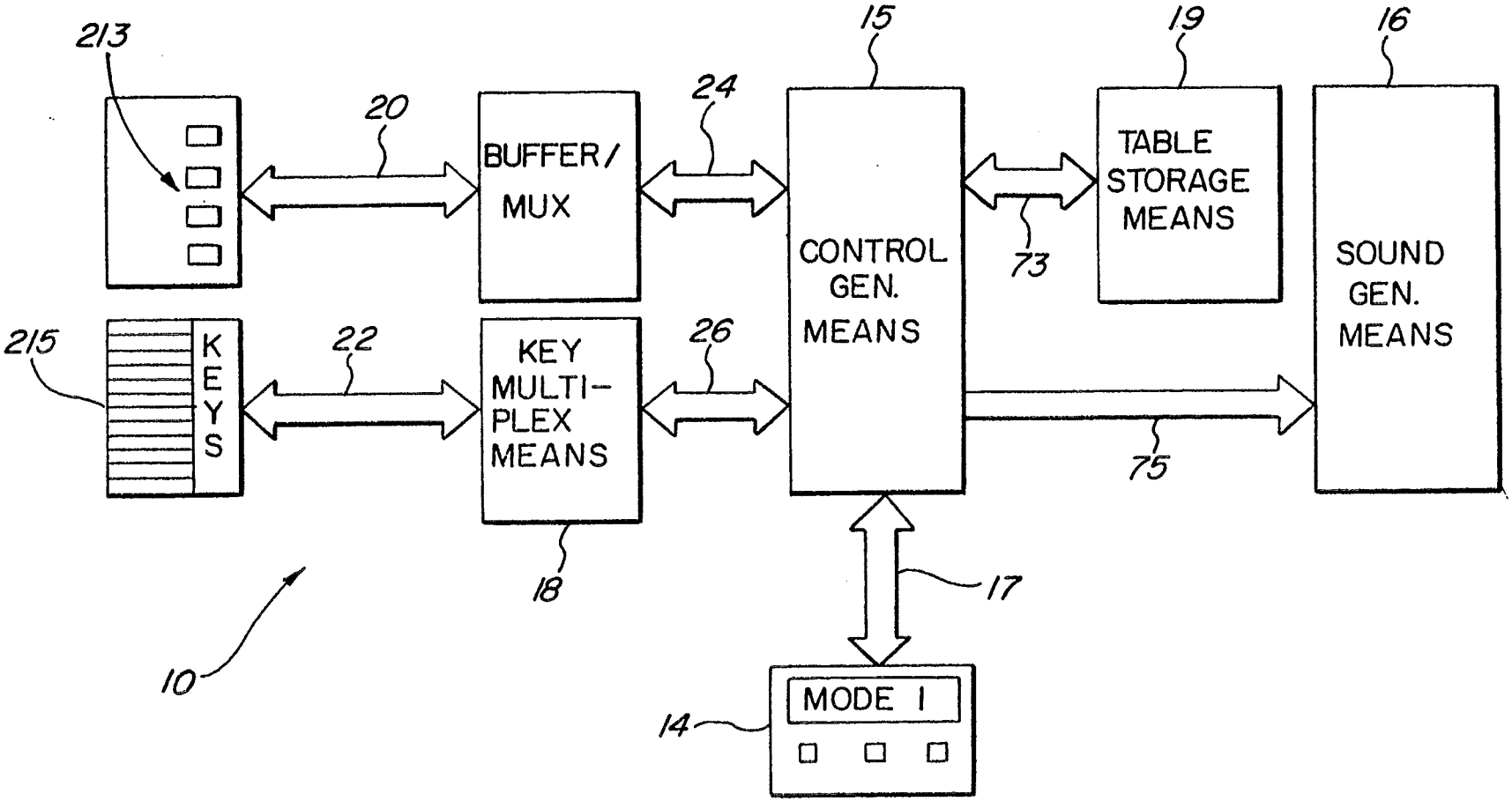
FIG. 16 is a system block diagram useful in discussing embodiments of the musical instrument of FIG. 14.

FIG. 16 illustrates the system block diagram of the electronics employed in conjunction with the keyboard 211 of FIG. 14. This circuitry is the same from a system standpoint as that disclosed in FIG. 11, with the exception that the output of the sensor means 11 comprises the electrical output of key set 213, which produces four binary-coded electrical signals. As previously discussed, the vector multiplex means 12 of FIG. 11 is altered in that the binary coded electrical signals go through buffers and/or multiplexers directly to the microprocessor without any predecoding. Additionally, the keys 13 comprise key set 215 of FIG. 14, which outputs to the key multiplex means 18.

In the embodiment of FIG. 14, table storage means 19 (FIG. 16) includes a number of sets of 15 chords in order to play a selection of songs. In the chord tables, selected melody notes are coded adjacent the notes of the 15 chords, in the same manner as in FIG. 9. Scales, bass runs, or percussive events can also be coded here. The selected melody notes correspond to a respective one of the keys of the second key set 215. The second key set 215 is a conventional piano or synthesizer keyboard employing 15 white keys 222 and 10 black keys 223.

Accordingly, when a key or keys of key set 213 are depressed, the control generation means extracts the appropriate notes of the chords selected by the binary key combination from the table storage means 19 and causes it to be outputted to sound generation means 16. When one of the keys of key set 215 is depressed, control generation means 15 extracts the corresponding note from the notes associated with the chord selected by the first key set 213. The code for that note is then transmitted to the sound generation means for sounding in conjunction with the chord selected by the first key set 213.

Figure 17:
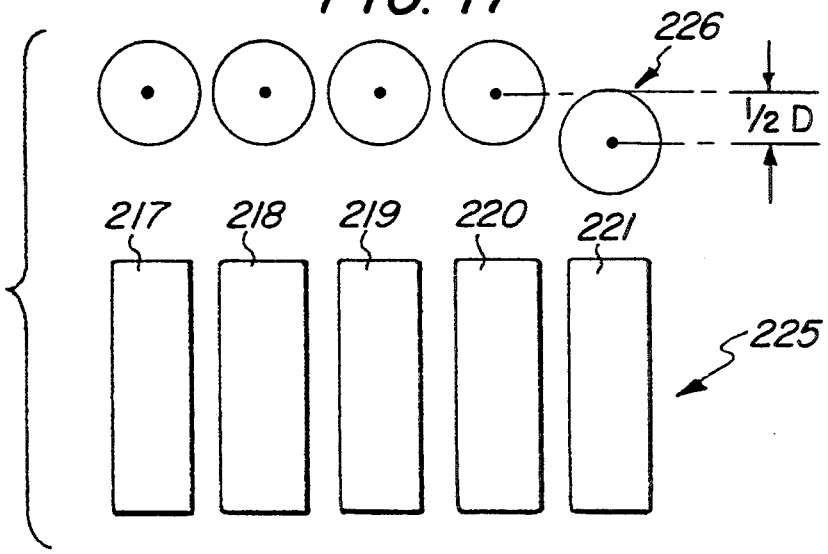
FIGS. 17–21 illustrate alternate key and corresponding direct notational schemes for the instrument of FIG. 14 according to the preferred embodiments.
Figure 18:
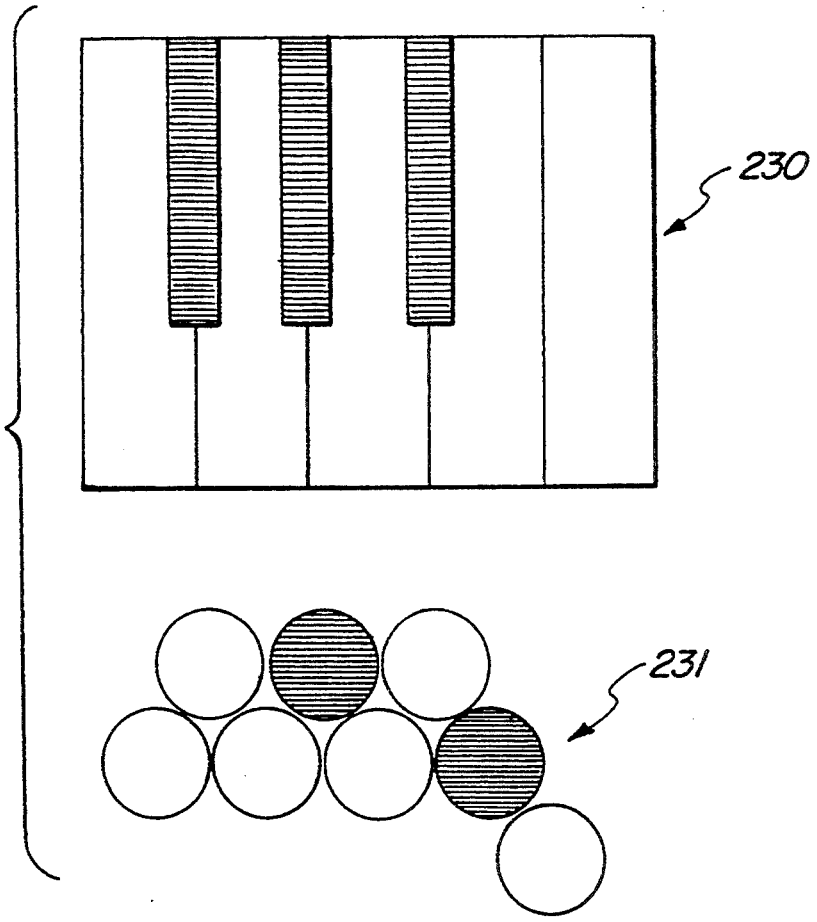

FIGS. 17 and 18 show alternative embodiments for the key set 213 of FIG. 14. In FIG. 17, a key set 225 is illustrated which comprises five horizontally-arranged keys. The additional key 221 added to the key set of FIG. 14 corresponds to circle 226 of the corresponding five-circle notation scheme, also shown in FIG. 17. Circle 226 is lowered, for example, by one-half-diameter below the centerline of the other four circles. The inventor has found that this lowering permits the user to readily translate a five-circle notation into activation of the five keys 225. In contrast, five circles all located on the same centerline present the user with a much more difficult translation task, as discussed earlier. Since only the least probable musical events are assigned typically to codes that include the thumb, the symbol can be presented as a four-symbol version until a musical event is encountered that requires the thumb, then the symbol is drawn with five elements. This makes the thumb even more conspicuous to the user, and therefore easier to decode in a timely manner.

The embodiment of FIG. 17 provides for generation of 31 chords or other musical events through left-hand thumb activation of key 221 and finger activation of the remaining keys 217–220. These keys 225 are preferably again implemented with touch-sensitive electric signal generation means to generate a five-digit binary code. The 31 possible chords selectable for each respective binary code combination are preferably selected according to the probability in which chords occur in popular music. As noted above, a set of 31 chords is sufficient for almost all popular songs, giving the 5-key set embodiment a considerable advantage over the 4 keys disclosed in connection with FIG. 14. A preferred set of 31 chords is illustrated in FIG. 15.

FIG. 18 illustrates an embodiment for the first key set 213 of FIG. 14 employing seven keys, these being five white keys and three black keys. The corresponding direct notation 231 is shown directly below the seven keys 230. This relatively easily understood notation and direct translation scheme permits the use of 38 chords, according to a construction similar to those described with respect to FIGS. 14 and 15.

Figure 20:
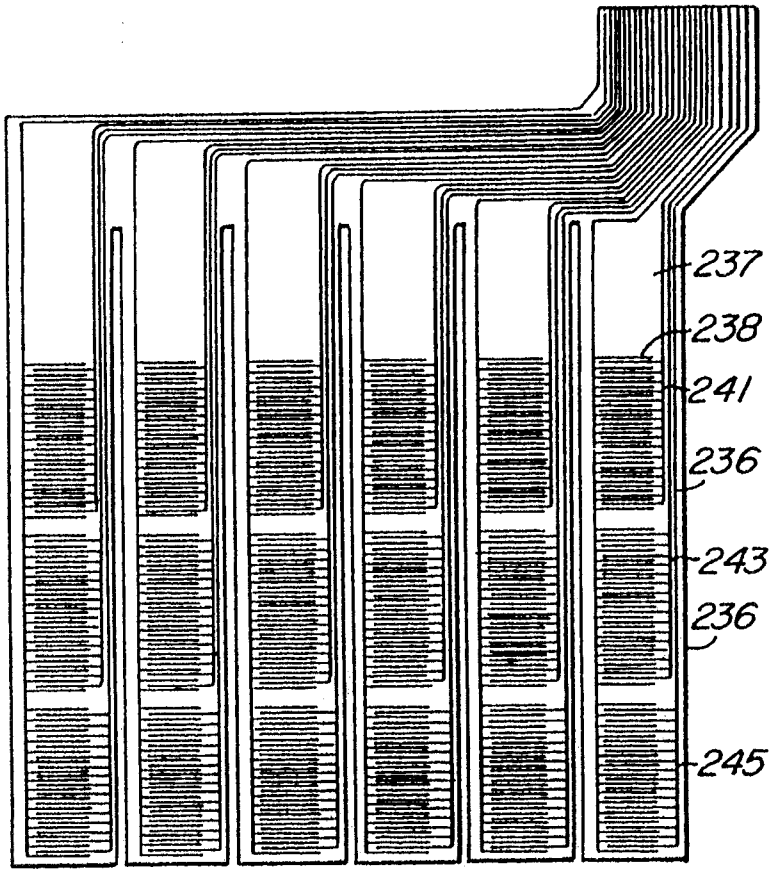
Figure 19:
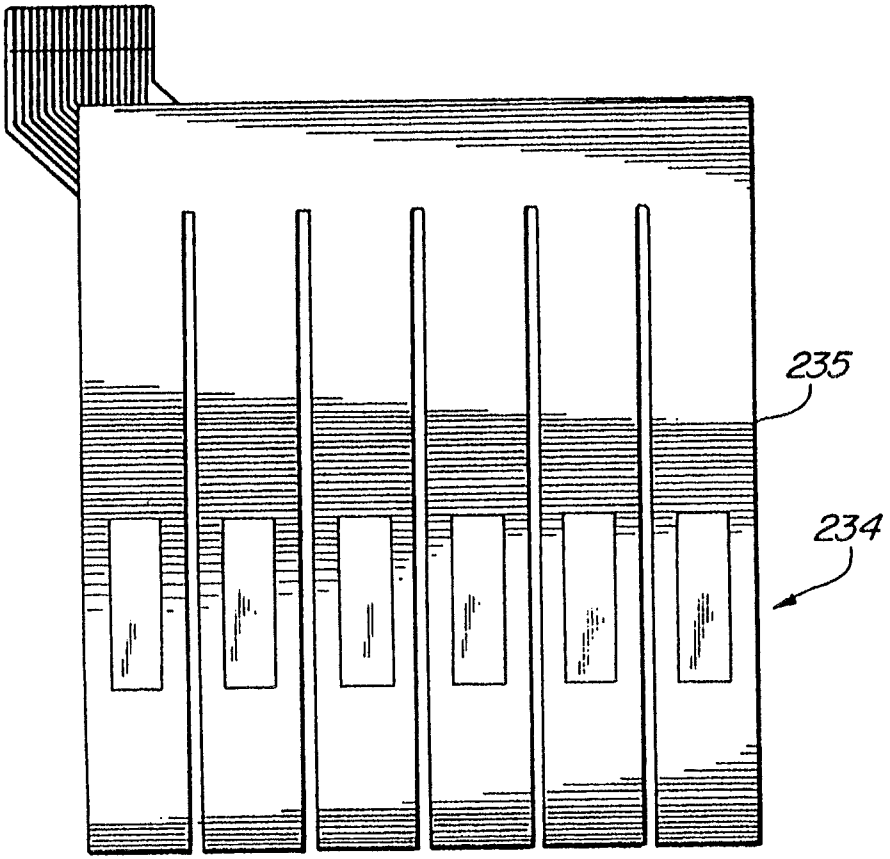

FIG. 19 discloses a six-key embodiment for use as key set 213 in FIG. 14. This six-key embodiment is employed with the direct notational scheme using three rows of six circles, as shown and discussed above in connection with FIG. 4. The six keys 234 shown in FIG. 17 preferably comprise a unitary overlay 235, including a number of touch-sensitive electronically-conductive portions 236, as shown in FIG. 20. FIG. 19 shows these keys 234 in full scale. The overlay 235 has an adhesive bottom covered with release paper. The release paper is peeled off and the overlay 235 is attached over six mechanically-depressible keys, similar to typical piano keys, as also used in the embodiment of FIG. 14 for key set 213.

Figure 21:
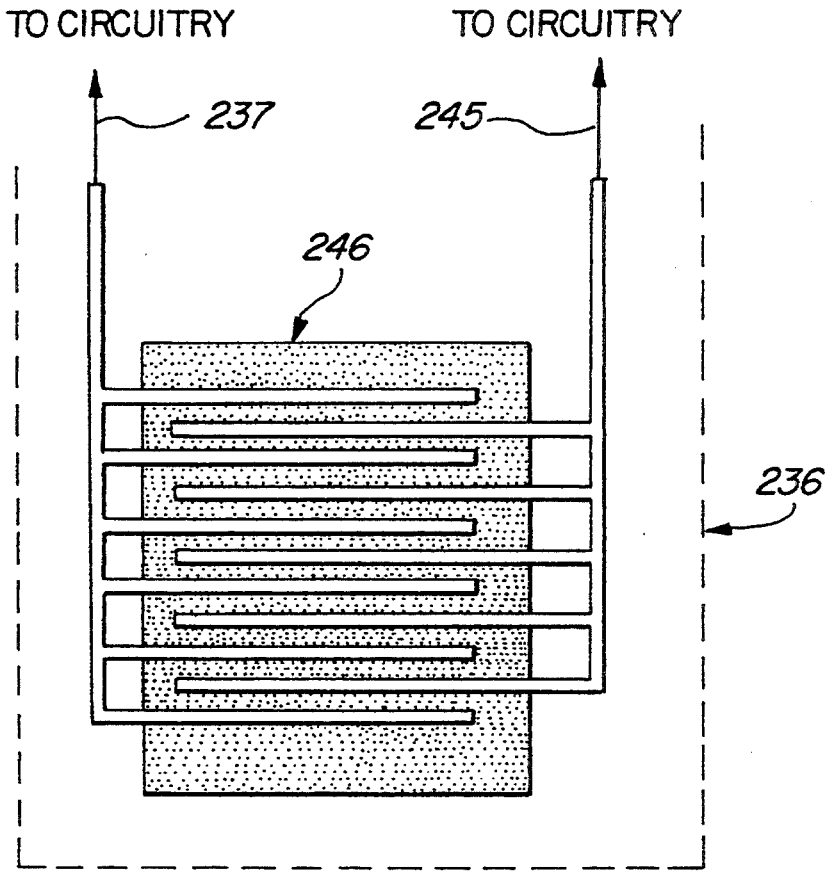

As shown in conjunction with FIGS. 20 and 21, each touch-sensitive area 236 employs a first conductor 237 providing a plurality of conductive fingers 238, and second, third, and fourth conductors 241, 243, 245 providing fingers which respectively intertwine with the fingers 238 of the first member in three vertically separate locations so as to establish three vertical touch-sensitive areas 234. The intertwining conductive fingers are constructed in a layer lying adjacent a conductive ink layer 246 such that depression causes the conductive ink layer to electrically interconnect the intertwined fingers. The same construction is used on each key such that three rows of six touch-sensitive areas 236 are provided on the keys, each touch-sensitive area corresponding to one of the circles of the directly translatable notation shown in FIG. 17 and FIG. 4. The touch-sensitive areas provide signals indicative of the magnitude (intensity) of depression, as well as depression itself, The key construction of FIGS. 19–21 provides 45 musical events; that is, 3 sets of 15 each. The six-key set can also be operated as any of the other modes described above. Moreover, if the thumb is permitted to be used in each of three rows (3 rows of 5 keys), one may produce 3 sets of 31 events (a total of 93). If all 6 keys having 3 sensors each are fully used, then the user has 3 sets of 15 events in the center; 3 sets of 7 events on the right side, and 3 sets of 7 events on the left side, for a total of 87 events such as chords (45+21+21). Shown below are the codes for such a set of 87. "X" means the key may or may not be pressed; the "1" says it must be pressed; the "0" says it cannot be pressed.

| | | | |
|---|---|---|---|
| 000000 | 0XXXX0 | 00XXX1 | 1XXX00 |
| 000000 | 0XXXX0 | 00XXX1 | 1XXX00 |
| 000000 | 0XXXX0 | 00XXX1 | 1XXX00 |

The circuitry necessary to interface to the FSRs (force-sensitive resistors) of FIGS. 20–21 is the same as a SINGLE element of the directional sensors; that is, a resistor tied to one of the supplies and the FSR acting as the pressure-sensitive element of a voltage divider, as shown in block 47 of FIG. 8.

The six-key left-hand key set 213 of FIGS. 19–21 is preferably used with a right-hand key set 215 which provides 15 white keys and 10 black keys, spanning two octaves.

There are several powerful possibilities inherent in the 6×3 matrix of sensors of FIGS. 19–21, which the moderate to advanced user would find very useful. To understand the possibilities, refer to the Table below. In the Table, a "0" indicates that the sensor is not pushed; a "1" indicates that the sensor must be pushed; and a "T" indicates that the user may choose to depress or to not depress the sensors so designated. Column 1 (C1) shows the 6×3 array with the user able to select any one of 15 combinations in the upper center section of the array. C2 shows that the user may select any of 15 combinations in the center-center section, and C3 shows a similar situation for the lower center. C4 shows that the user must depress the leftmost sensor but then may select any of the seven combinations with the remaining three fingers. Note that requiring depression of the leftmost sensor is necessary to distinguish between a code of 000110 which could have been made by the hand over the center position or over the right position—the rightmost sensor depressed removes any uncertainty. Similar codes are available for the other right positions as well as for the leftmost position.

TABLE

| C1 | C2 | C3 | C4 | C5 |
|---|---|---|---|---|
| 0TTTT0 | 000000 | 000000 | 00TTT1 | 000000 |
| 000000 | 0TTTT0 | 000000 | 000000 | 00TTT1 |
| 000000 | 000000 | 0TTTT0 | 000000 | 000000 |
| **C6** | **C7** | **C8** | **C9** | |
| 000000 | 1TTT00 | 000000 | 000000 | |
| 000000 | 000000 | 1TTT00 | 000000 | |
| 00TTT1 | 000000 | 000000 | 1TTT00 | |

Therefore, there are 9 areas that the user can place his or her 4 fingers—3 of these areas can give 15 combinations, and 6 of these areas can give 7 combinations. If the user assigns these nine positions to nine root names such as G, C, F, Bb, etc., and the fingerings in those positions to chord types such as Maj, Min, Seventh, etc., then the user can start to memorize the locations and fingerings and start playing the device "by ear." That is, if the center-center is C and the fingering 1001 is Major, then moving to the right and doing 1001 with the fingers also generates a Major chord but in the root of that location, which may be G, for example. The same fingering can be moved to any of the other locations and generate major chords as well. If 1011 is a seventh, then nine sevenths can be generated, depending on the needs. Keep in mind that some fingerings such as 1000 should "change to" 1001 when moved to the right, since the system requires that the rightmost sensor be depressed. However, by viewing the other bits as the chord definition, the user may quickly become accustomed to always depressing the outside finger when moving right or left. By placing the tonic, fourth, and fifth roots in the center three positions, the user can take advantage of the 15 chords available there that would never be needed by the roots that occupy the outside positions.

FIGS. 22–25 graphically illustrate a method for allowing "normal" keys to be remapped by software to allow sight reading of melodies on off-the-shelf sheet music. In this implementation, the physical representation of notes (sheet music) is correlated one-for-one with the physical keys.

Figure 22:
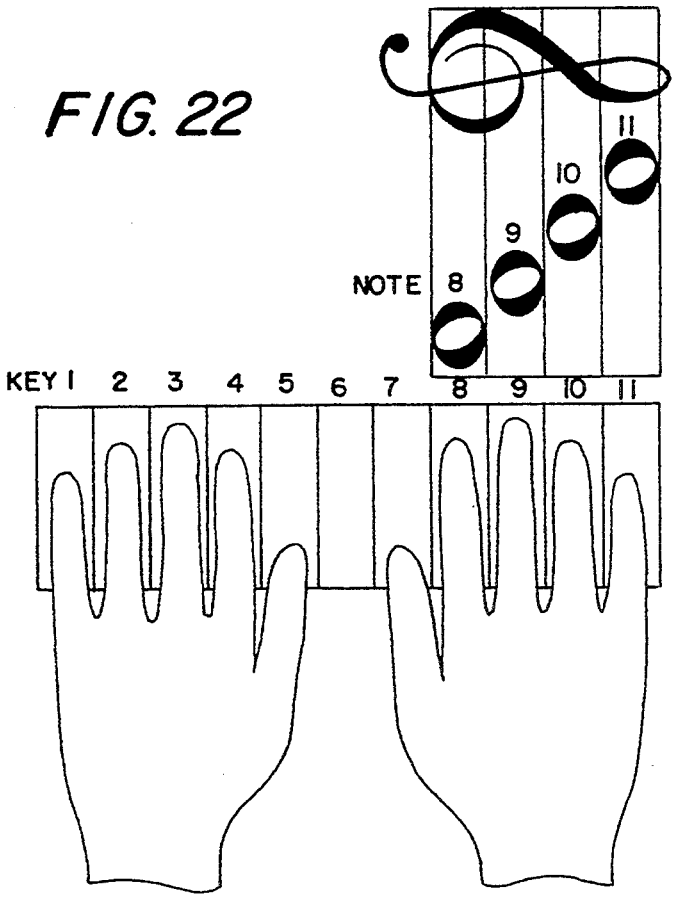
FIGS. 22–25 are schematic fingering charts illustrating a method for remapping normal keys for direct translation.
Figure 24:
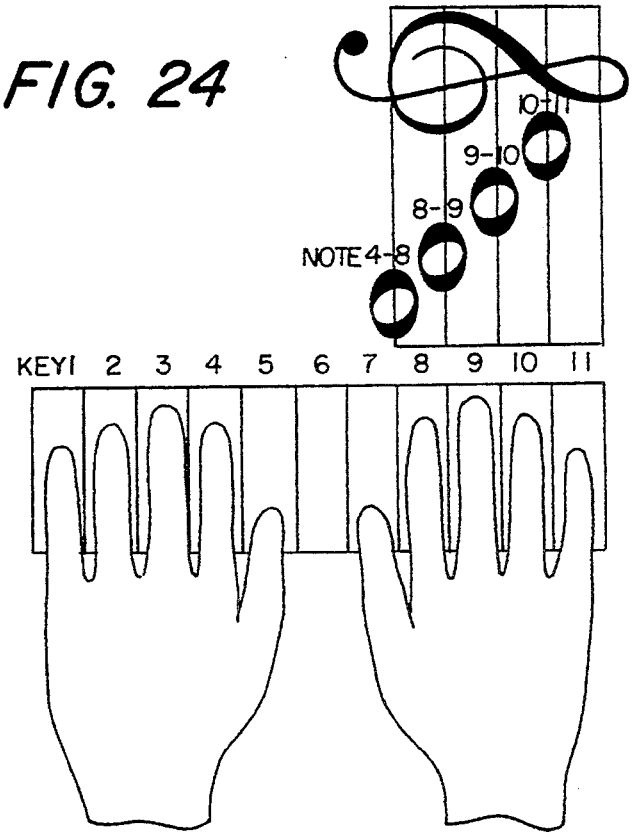

FIG. 22 shows how the four notes that fall on the spaces of a staff correlate to four individual right-hand keys on the keyboard. That is, to play note 11 (E), simply depress key 11; to play note 10 (C), depress key 10, etc. This method does not support more than one note at a time. FIG. 24 shows how to play the notes that all lie on the lines of a staff. That is, to play note 10-11 (D), depress keys 10 and 11; to play note 9-10 (B), depress keys 9 and 10, etc. Notice that all notes that fall on lines are played by depressing the two fingers corresponding to the two spaces that "surround" that line. Also notice that note 4-8 (E) is also played using the two "space" fingers surrounding that line—the fingers, though, are on opposite hands. The purpose of using the fingers, as opposed to the thumbs, is to reserve the thumbs for functions to be described later.

Figure 23:
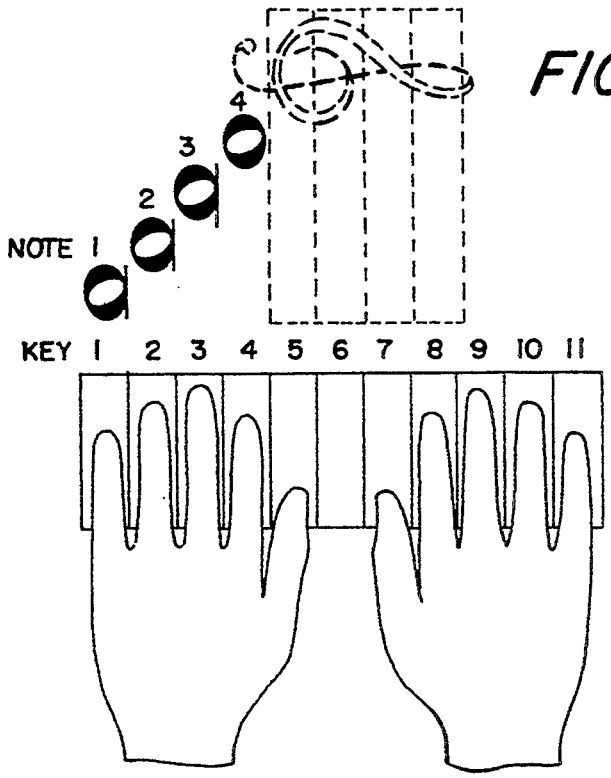
Figure 25:
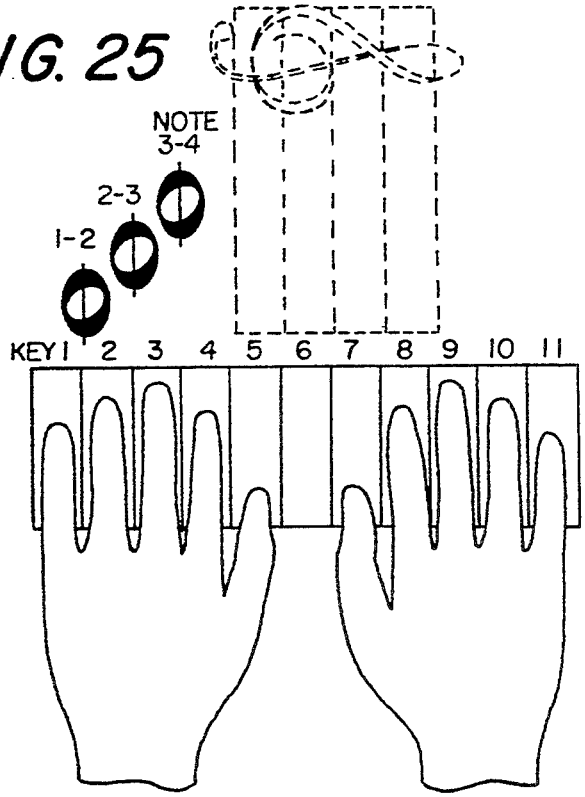

FIG. 23 shows how the notes that fall on the spaces below the staff correlate to the four individual keys of the left hand. Again, to play note 1, depress key 1, etc. FIG. 25 shows how the notes fall on the lines below the staff. To play note 1-2, depress the two keys, key 1 and key 2, etc.

Although the staff if shown rotated 90 degrees from "normal," this inventor has found that with only a few minutes of practice, users can quickly adjust to reading the more universal, horizontally-presented sheet music.

The three center keys (5–7) have special uses. When using this system the user would typically input (via the mode control means 14), the key in which the song is to be played. The software then automatically takes care of sharps and flats related to that key. For example, if the chosen key was F (having one flatted note, B), then each time the user plays a B note, the software will flat it. However, in some cases songs have "accidentals"—that is, notes that are sharped or flatted in addition to the ones that are associated with the key signature. Also, there are cases where the sharps and flats associated with the key are "unsharped" or "unflatted"—called "naturals." Therefore, the thumbs are used to activate the sharp or flat keys to execute the necessary accidentals or naturals. Such executions are infrequent and, in most cases, easily handled.

The center key (key 6), labeled shift, is available for single-hand playing if desired by the user. Again, via the mode control 14, the user could select "Single Hand Melody," for example, and enter this special mode. In this mode only the right hand is used. The notes on the staff are played as just described in the two-hand method except that flats would require the user to extend his or her thumb down to the flat key to activate it when necessary. However, when a note appears below the staff (either a space note or a line note), the user would activate the "Shift" key and his or her right-hand fingers would then "become" the left-hand fingers, and he or she would play those notes as before, except they would produce the appropriate notes. This mode allows the user then to play left-hand chords along with the melody if he or she desires. It should be noted, however, that this is a more difficult method for reading sheet music directly. If, however, specially notated sheet music is presented to the user having the five-symbol notation according to the invention, it is much simpler to execute with a single hand.

Figure 27:
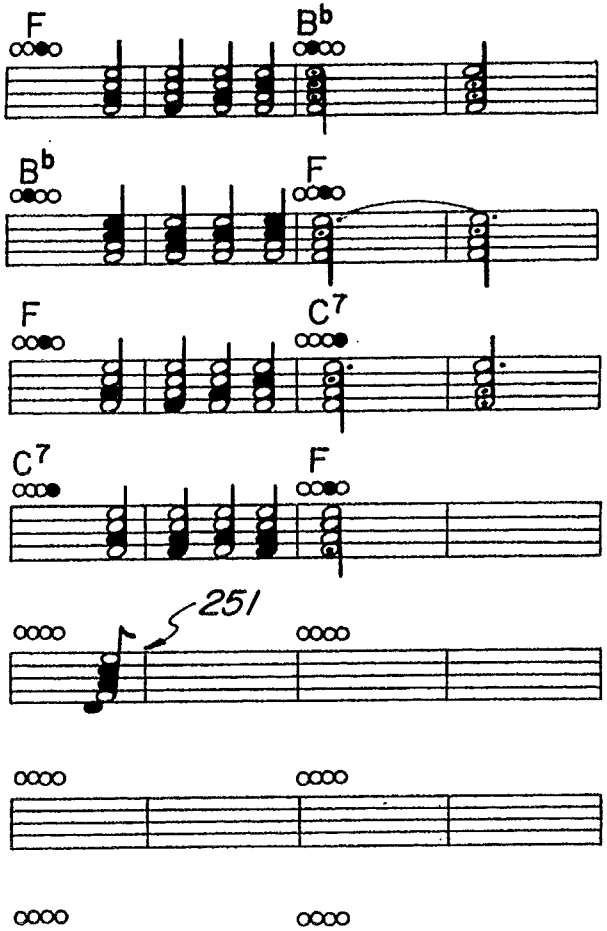
FIGS. 26 and 27 illustrate sheet music with direct notational translation added.
Figure 26:
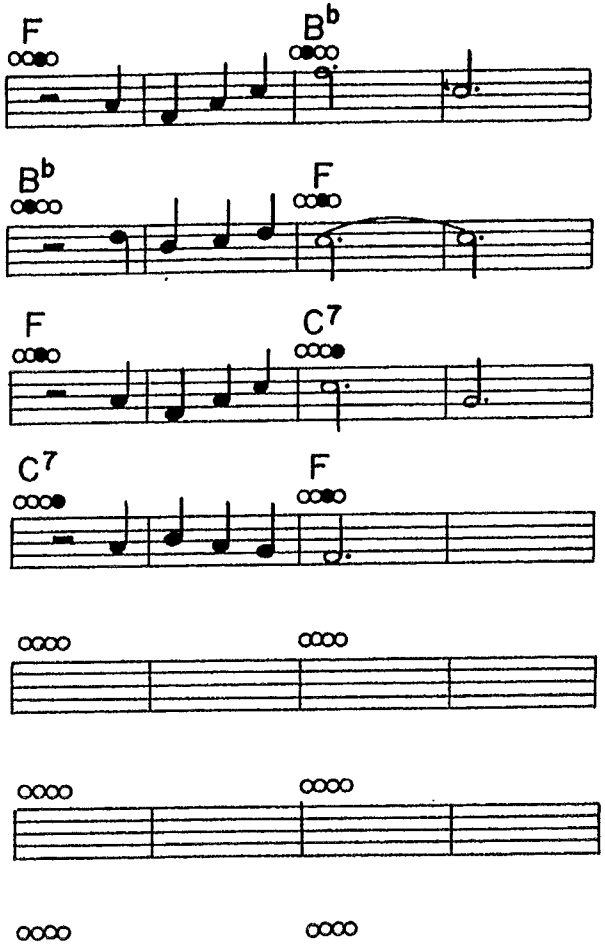

Specially notated sheet music is illustrated in FIGS. 26–27. FIG. 27 illustrates notation for individual notes of "On Top of Old Smokey" using four-circle vertical notation. Five-circle notation is similarly arranged vertically, as shown by the example symbol 251.

As will be appreciated, electronic musical instruments according to the preferred embodiments permit the user to access an expert system prior to playing. The player may select the key (C major, etc.), the style (blues, rock, classical, etc.), the tempo, embellishment, part to be played (bass, lead, chords, improvisation, etc.) Software preselects certain parts of the stored data (the "knowledge base"). During its use, the instrument may also be updated by the player as desired, instantly mapping the keys on the instrument to present musically correct alternatives to the user. The musician can play freely, concerned only with his or her own creative results.

As noted above, the preferred embodiments take advantage of the observation that when, for example, an expert blues musician is playing piano accompaniment on a medium tempo song, he or she does not use all 88 keys; in fact, the player would use very few keys. The actual notes that he or she would choose to use are predictable within some boundary. The order and timing of the notes are less predictable and are subject to the musician's own "musical personality." By preselecting the blues style, tempo, bass accompaniment, etc., a player is offered only the actual notes which produce correct results, i.e., blues, leaving the player free to assert his or her personality without concern for incorrect results.

Programming may be both permanent and by use of ROM cards. ROM cards are plug-in changeable memory cards which are used to enhance the permanent memory of the instrument. Such cards allow the musician to have additional modes of music styles, scales, and instrument emulations readily available. They can also be used to provide the player an opportunity to play one piece in a group of instruments. For example, a ROM card can provide the drums, piano, and saxophone, and leave the guitar accompaniment to the player. The card can also show on the screen of the instrument the words to songs so that the player may sing to the music played.

One of the most notable elements of the preferred embodiments is the capability to allow the player to immediately play by "sight reading" from specially notated sheet music. This notational scheme results from careful analysis of the difficulties people have in learning and playing traditionally notated music. The new notational scheme allows the reader to observe the symbols and manipulate keys without having to make a mental translation.

In view of the above, those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A system for controlling a sound generation means to play desired music, comprising:

an array of at least two sensor means responsive to activation by the fingers of a user's hands, each sensor means being responsive to fingering operations for generating an output signal having at least two states per said sensor means, each sensor means positioned for activation by one particular finger of the user, each output of each sensor means being associated with a corresponding binary digit of a digital code, each of a plurality of said digital codes representing a different chord to be sounded by said sound generation means, such that no individual musical note is associated with any one of said sensor means, any one digit of said digital code thus having musical significance only in combination with other digits of said code;

instruction means for visually conveying to a user a succession of combinations of desired fingering operations required for selectively activating said sensor means to play the desired music and for instructing the user as to which combination of fingers to use at any one time, said instruction means comprising a succession of instruction sets for reference at respective successive instants in time, each instruction set having a plurality of graphic symbols positioned therein, the same symbol position in each successive set being mapped into physical one-to-one correspondence with the same respective said sensor means, each said symbol position having a graphic symbol located therein having at least first and second states, whereby a first of said sensor means is exclusively activated by a first finger of the user exclusively in response to the state of the symbol in a first position of each of said successive sets and a second of said sensor means is exclusively activated by a second finger of the user exclusively in response to the state of the symbol in a second position of each of said successive sets; and decoding means receiving the states of said plurality of sensor means and responsive thereto for generating control signals for supply to said sound generation means.

2. The system of claim 1 wherein said at least two sensor means are further positioned for manual activation without substantial lateral hand movement by the user.

3. The system of claim 1 wherein said array of sensor means comprises a chord selection means for selecting one of a plurality of chords and further including means for generating signals corresponding to musical notes which harmonize with the selected chord.

4. A system for controlling a sound generation means, comprising:

an array of four or more sensor means, each having a common width, each said sensor means being responsive to activation by the fingers of a user's hands, the sensor means being arranged adjacent one another such that they may be accessed without lateral hand movement by the user in excess of said width in either lateral direction, each sensor means being positioned for activation by one particular finger of the user;

instruction means for visually conveying to the user a succession of instructions for generating desired sounds by selective activation of said sensor means, said instructions representing a succession of different desired fingering operations and instructing the user as to which combination of fingers to use in each of said succession of fingering operations, said instruction means comprising a succession of instruction sets, each instruction set having a plurality of graphic symbols each in an assigned position within said set, the same symbol position in each set being mapped into physical one-to-one correspondence with a respective said sensor means and having at least first and second states, whereby a first of said sensor means is exclusively activated by a first finger of the user exclusively in response to the state of a first of said symbols and a second of said sensor means is exclusively activated by a second finger of the user exclusively in response to the state of a second of said symbols; and decoding means receiving said states and responsive thereto for generating control signals for supply to said sound generation means.

5. The system of claim 4 wherein said array of sensor means comprises a chord selection means for selecting one of a plurality of chords and further including means for generating signals corresponding to musical notes which harmonize with the selected chord.

6. An electronic musical instrument comprising:

at least four first key means, each for generating a respective first key signal when depressed;

a plurality of second keys, each for generating a second key signal when depressed;

notational means comprising a series of symbol sets, each symbol set having four symbol positions, each position being occupied by a respective one of four adjacent geometric symbols, the same respective one of said first key means being assigned to the same symbol position for each set of said series in the sense that the geometric symbol in the same selected one of the four positions directs whether or not the corresponding first key means is actuated at any one time, each symbol thus having two states, there thus being a one-to-one correspondence between said geometric symbols and said first key means; and means responsive to said first key signals for sounding one of a group of selected musical events.

7. The instrument of claim 6 wherein melody notes falling on the staff are correlated one for one with a set of said second keys.

8. The instrument of claim 7 wherein the thumbs are used to activate keys of said set to produce sharps or flats.

9. The instrument of claim 6 wherein said notation comprises at least four adjacent circles.

10. The instrument of claim 9 wherein said circles are arranged vertically to indicate a selected note to be played.

11. The instrument of claim 9 wherein said circles are arranged horizontally and represent a chord to be played.

12. The instrument of claim 10 wherein said notation comprises four adjacent circles on the same centerline and one circle whose center is displaced from said centerline.

13. The instrument of claim 10 wherein said notation comprises groups of three rows of six circles.

14. The instrument of claim 12 wherein said circles are arranged vertically to indicate a selected note to be played.

15. The instrument of claim 8 wherein said circles are arranged horizontally and represent a chord to be played.

16. The instrument of claim 14 wherein said circles are arranged vertically to indicate a selected note to be played.

17. The instrument of claim 14 wherein said circles are arranged horizontally and represent a chord to be played.

18. An electronic musical instrument comprising:

a plurality of first key means, each for generating a first key signal when depressed;

a plurality of second keys, each for generating a second key signal when depressed;

notational means having a plurality of graphic symbols equal in number to the number of first key means, with one symbol corresponding to a respective one of said first key means in the sense that the symbol directs whether or not the corresponding first key means is actuated at any one time, each symbol thus having two states, there thus being a one-to-one correspondence between said symbols and said plurality of first key means; and means responsive to said first key signals for sounding one of a group of selected chords, there being at least $2^{n-1}$ chords in said group, where n is the number of said first key means.

19. The instrument of claim 18 wherein said notation comprises at least four adjacent circles.

20. The instrument of claim 18 further including means responsive to said second key signals for causing each of said second keys, when depressed, to produce a selected note, said note being selected to harmonize with said one of a selected group of chords.

21. The instrument of claim 18 wherein said notation is arranged on a staff.

22. The instrument of claim 18 wherein said group of chords is selected based on the probability of occurrence of chords in a selected type of music.

23. The instrument of claim 22 wherein said notation comprises four adjacent circles on the same centerline and one circle whose center is displaced from said centerline.

24. The instrument of claim 22 wherein said notation comprises groups of three rows of six circles.

25. An electronic musical instrument comprising:

a first key set of six keys, each said key having three sensor areas thereon, each sensor area for generating a respective first key signal when depressed;

a plurality of second keys, each for generating a respective second key signal when depressed;

notational means for instructing the user as to the music to be played on said instrument by selective actuation of said six keys, said notational means comprising a series of sets of visually perceivable graphic symbols, each set having three rows of six said symbols, with the same symbol position in each of said sets being mapped into a one-to-one correspondence with the same respective sensor area of the first key set in the sense that the symbol directs whether or not the corresponding sensor area is to be actuated at any one time, each symbol thus having two states, there thus being a one-to-one correspondence between symbols and sensor areas;

means responsive to said first key signals for sounding one of a plurality of selected chords; and means responsive to said second key signals for causing each of said second keys, when depressed, to play a selected note.

26. The instrument of claim 25 wherein said means responsive to said second key signals automatically causes said selected notes to harmonize with the chord being sounded.

27. The instrument of claim 26 wherein said notes are coded in a digital storage table adjacent the matching chord.

28. The instrument of claim 25 wherein said sensor areas comprise a 6×3 rectangular matrix of sensor areas.

29. The instrument of claim 28 wherein said sensor areas comprise:

an overlay providing a surface layer depicting six rectangular keys and having an adhesive backing thereon; and conductor means between said overlay and adhesive backing for forming said 6×3 matrix of sensor areas and responsive to finger pressure to generate electrical output signals indicative of depression of respective sensor areas of said 6×3 matrix.

30. A method for activating a sound generation means to play desired music, comprising:

arraying a plurality of sensor means, each sensor means being responsive to activation by the fingers of a user's hands, each sensor means further being responsive to fingering operations for generating an output having at least two states per said sensor means, each sensor means positioned for activation by one particular finger of the user;

providing a set of instructions for visually conveying to a user desired fingering operations required for playing the desired music and for instructing the user as to which combination of fingers to use at any one time, said instructions comprising a plurality of successive sets of graphic symbols, the same symbol position in each set being mapped into physical one-to-one correspondence with the same respective said sensor means and having at least first and second states;

activating a first of said sensor means exclusively by a first finger of the user exclusively in response to the state of a first of said graphic symbols; and activating a second of said sensor means exclusively by a second finger of the user exclusively in response to the state of a second of said symbols.

31. The method of claim 30 further including the steps of:

decoding the states of said plurality of sensor means; and generating control signals for supply to said sound generation means in response to said decoding.

32. The method of claim 30 further including the step of assigning each of the outputs of the plurality of said sensor means to a selected bit position of a digital code whereby up to $2^n-1$ chords may be represented by said outputs where "$n$" is the number of said sensor means.

33. Apparatus for controlling a sound generation means comprising:

a plurality of first key means, each for generating a first key signal when depressed;

a plurality of second keys, each for generating a second key signal when depressed;

notational means having a plurality of graphic symbols equal in number to the number of first key means, with one symbol corresponding to a respective one of said first key means in the sense that the symbol directs whether or not the corresponding first key means is actuated at any one time, each symbol thus having two states, there thus being a one-to-one correspondence between said symbols and said plurality of first key means; and means responsive to said first key signals for selecting one of a group of chords for play, there being at least $2^n-1$ chords in said group, where n is the number of said first key means.

* * * * *